US010423097B2

(12) United States Patent
Hayami

(10) Patent No.: US 10,423,097 B2
(45) Date of Patent: Sep. 24, 2019

(54) IMAGE FORMATION APPARATUS AND IMAGE FORMATION METHOD

(71) Applicant: KONICA MINOLTA, INC., Chiyoda-ku, Tokyo (JP)

(72) Inventor: Toshiki Hayami, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/971,112

(22) Filed: May 4, 2018

(65) Prior Publication Data

US 2018/0335717 A1 Nov. 22, 2018

(30) Foreign Application Priority Data

May 19, 2017 (JP) ..... 2017-099736

(51) Int. Cl.
*G03G 15/16* (2006.01)
*G03G 15/18* (2006.01)
*G03G 15/01* (2006.01)

(52) U.S. Cl.
CPC ..... *G03G 15/169* (2013.01); *G03G 15/0189* (2013.01); *G03G 15/18* (2013.01)

(58) Field of Classification Search
CPC ..... G03G 15/169
See application file for complete search history.

(56) References Cited

U.S. PATENT DOCUMENTS 5,561,510 A * 10/1996 Kamp ..... G03G 15/162 399/302
6,088,565 A * 7/2000 Jia ..... G03G 15/161 399/302
6,411,793 B1 * 6/2002 Badesha ..... G03G 15/161 399/237
6,647,237 B2 * 11/2003 Schlueter, Jr. ..... B32B 1/08 399/307
2007/0253753 A1 * 11/2007 Yamaji ..... G03G 15/1605 399/302
2009/0190973 A1 * 7/2009 Hamahashi ..... G03G 15/0131 399/308

FOREIGN PATENT DOCUMENTS

JP 2014-010383 A 1/2014

* cited by examiner

*Primary Examiner* — Carla J Therrien
(74) *Attorney, Agent, or Firm* — Buchanan Ingersoll & Rooney PC

(57) ABSTRACT

An image formation apparatus includes: a plurality of image formers each of which is provided for each color and forms a toner image; a plurality of image carriers each of which is provided in accordance with each of the image formers and carries the toner image formed by each image former; a first intermediate transfer body on which multiple toner images are formed; a secondary transferor that secondarily transfers to a sheet, the multiple toner images formed on the first intermediate transfer body; and an adhesion force reducer that is provided between a position where the multiple toner images are formed on the first intermediate transfer body and a secondary transfer position of the secondary transferor and that reduces an adhesion force of toner included in the multiple toner images formed on the first intermediate transfer body.

5 Claims, 16 Drawing Sheets

FIG. 5

| SYSTEM SPEED | 400mm/sec | |
|---|---|---|
| FIRST INTERMEDIATE TRANSFER BODY | MATERIAL | POLYIMIDE RESIN |
| | THICKNESS | 80μm |
| | SURFACE RESISTANCE | 11LogΩ/□ |
| PRIMARY TRANSFER MEMBER (COMMON AMONG RESPECTIVE COLORS) | MATERIAL | NBR SPONGE RUBBER ROLLER |
| | RESISTANCE | 7.5logΩ |
| | HARDNESS | Aske-C 35° |
| | OUTER DIAMETER | φ20 |
| | PRESSING FORCE | 10N |
| FIRST COUNTER MEMBER | MATERIAL | NBR SPONGE RUBBER ROLLER |
| | RESISTANCE | 7.5logΩ |
| | HARDNESS | Aske-C 30° |
| | OUTER DIAMETER | φ38 |
| | PRESSING FORCE | 10N |
| SECOND INTERMEDIATE TRANSFER BODY | MATERIAL | POLYIMIDE RESIN |
| | THICKNESS | 80μm |
| | SURFACE RESISTANCE | 11LogΩ/□ |
| FIRST SECONDARY TRANSFER MEMBER | MATERIAL | NBR SOLID RUBBER ROLLER |
| | RESISTANCE | 7.5logΩ |
| | HARDNESS | Aske-C 60° |
| | OUTER DIAMETER | φ38 |
| SECOND COUNTER MEMBER | MATERIAL | NBR SPONGE RUBBER ROLLER |
| | RESISTANCE | 7.5logΩ |
| | HARDNESS | Aske-C 30° |
| | OUTER DIAMETER | φ38 |
| | PRESSING FORCE | 10N |

FIG. 7

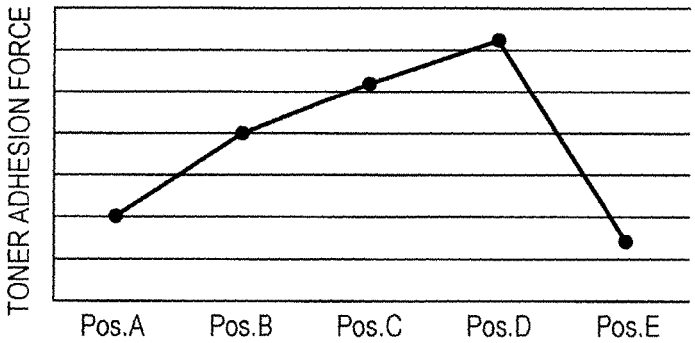

FIG. 8

| SYSTEM SPEED | 400mm/sec | |
|---|---|---|
| FIRST INTERMEDIATE TRANSFER BODY | MATERIAL | POLYIMIDE RESIN |
| | THICKNESS | 80μm |
| | SURFACE RESISTANCE | 11LogΩ/□ |
| PRIMARY TRANSFER MEMBER (COMMON AMONG RESPECTIVE COLORS) | MATERIAL | NBR SPONGE RUBBER ROLLER |
| | RESISTANCE | 7.5logΩ |
| | HARDNESS | Aske-C 35° |
| | OUTER DIAMETER | φ20 |
| | PRESSING FORCE | 10N |
| FIRST COUNTER MEMBER | MATERIAL | NBR SPONGE+SOLID |
| | RESISTANCE | 7.5logΩ |
| | HARDNESS | Aske-C 45° |
| | OUTER DIAMETER | φ38 |
| | PRESSING FORCE | 80N |

| | FIRST EMBODIMENT | COMPARATIVE EXAMPLE |
|---|---|---|
| HALFTONE | ◎ | △ |
| ONE-LAYER SOLID PRINTING | ◎ | × |
| TWO-LAYER SOLID PRINTING | ○ | × |

◎ ○ △ ×
EXCELLENT ←→ POOR

FIG. 11

| SYSTEM SPEED | | 400mm/sec |
|---|---|---|
| FIRST INTERMEDIATE TRANSFER BODY | MATERIAL | POLYIMIDE RESIN |
| | THICKNESS | 80μm |
| | SURFACE RESISTANCE | 11LogΩ/□ |
| PRIMARY TRANSFER MEMBER (COMMON AMONG RESPECTIVE COLORS) | MATERIAL | NBR SPONGE RUBBER ROLLER |
| | RESISTANCE | 7.5logΩ |
| | HARDNESS | Aske-C 35° |
| | OUTER DIAMETER | ϕ20 |
| | PRESSING FORCE | 10N |
| COUNTER MEMBER | MATERIAL | NBR SPONGE+SOLID |
| | RESISTANCE | 7.5logΩ |
| | HARDNESS | Aske-C 45° |
| | OUTER DIAMETER | ϕ38 |
| | PRESSING FORCE | 80N |
| SECONDARY TRANSFER MEMBER | MATERIAL | NBR SOLID RUBBER ROLLER |
| | RESISTANCE | 7.5logΩ |
| | HARDNESS | Aske-C 70° |
| | OUTER DIAMETER | ϕ38 |
| ADHESION FORCE REDUCER | ELECTROSTATIC LATENT IMAGE CARRIER | PHOTORECEPTOR (SAME ONE IS USED FOR OTHER COLORS) |
| | VOLTAGE APPLICATION MEMBER: MATERIAL | NBR SPONGE RUBBER ROLLER |
| | VOLTAGE APPLICATION MEMBER: RESISTANCE | 7.5logΩ |
| | VOLTAGE APPLICATION MEMBER: HARDNESS | Aske-C 35° |
| | VOLTAGE APPLICATION MEMBER: OUTER DIAMETER | ϕ20 |
| | VOLTAGE APPLICATION MEMBER: PRESSING FORCE | 5N |

| | |
|---|---|
| TRANSFER BELT | POLYIMIDE RESIN |
| PRIMARY TRANSFER COUNTER MEMBER | NBR SOLID RUBBER ROLLER |
| TENSION ROLLER | METAL (SUS303) ROLLER |

FIG. 17A
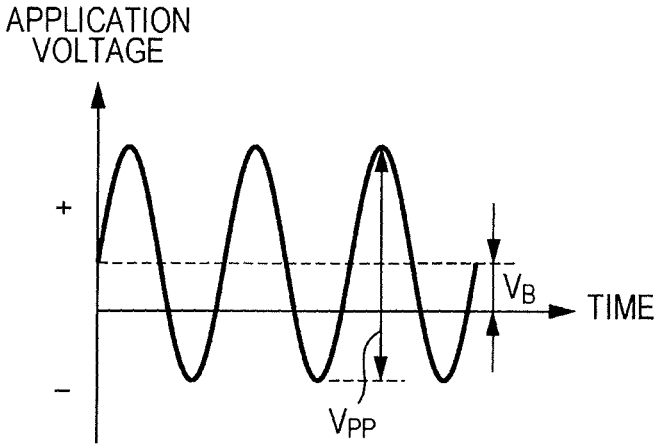
FIG. 17B
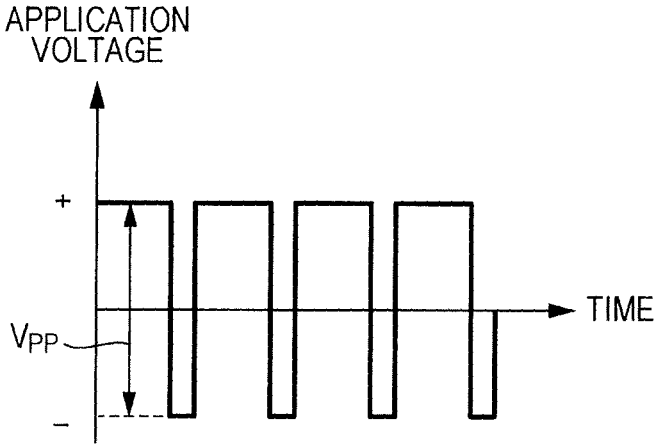
FIG. 18
| | |
|---|---|
| ENVIRONMENT | 20°C/50% |
| ATVC RESULT | 2.0kV |

| | FOURTH EMBODIMENT | COMPARATIVE EXAMPLE |
|---|---|---|
| HALFTONE | ◎ | △ |
| ONE-LAYER SOLID PRINTING | ◎ | × |
| TWO-LAYER SOLID PRINTING | ○ | × |

◎ ○ △ ×
EXCELLENT ←→ POOR

| | FIFTH EMBODIMENT | COMPARATIVE EXAMPLE |
|---|---|---|
| HALFTONE | ◎ | △ |
| ONE-LAYER SOLID PRINTING | ◎ | × |
| TWO-LAYER SOLID PRINTING | ○ | × |

◎ ○ △ ×
EXCELLENT ←→ POOR

FIG. 23

| | | PAPER WIDTH | | | |
|---|---|---|---|---|---|
| | | 150mm OR LESS | 151mm TO 210mm | 211mm TO 300mm | 300mm OR MORE |
| BASIS WEIGHT | 60gsm OR LESS | ±0 | ±0 | ±0 | ±0 |
| | 61 TO 80gsm | +5 | +5 | ±0 | ±0 |
| | 81 TO 105gsm | +5 | +5 | +5 | ±0 |
| | 106 TO 128gsm | +10 | +10 | +5 | ±0 |
| | 129 TO 160gsm | +15 | +15 | +10 | ±0 |
| | 161 TO 200gsm | +20 | +15 | +10 | ±0 |
| | 200gsm OR MORE | +25 | +20 | +15 | ±0 |

IMAGE FORMATION APPARATUS AND IMAGE FORMATION METHOD

The entire disclosure of Japanese patent Application No. 2017-099736, filed on May 19, 2017, is incorporated herein by reference in its entirety.

BACKGROUND

Technological Field

The present invention relates to an image formation apparatus and an image formation method for transferring multiple color toner images to an intermediate transfer body and transferring the toner images collectively to a sheet.

Description of the Related Art

In an image formation system, a toner image of each color based on an electrostatic latent image formed on a photoreceptor of each color (electrostatic latent image carrier) is transferred to an intermediate transfer body multiple times by a primary transferor, and then the toner images obtained by the multiple transfers (hereinafter referred to as "multiple toner images") are collectively transferred to a sheet (recording medium) in a secondary transferor. In a case of using uneven paper in such an image formation system, the transfer property from the intermediate transfer body to the uneven paper tends to be remarkably low. The uneven paper is a sheet with low flatness having unevenness on a surface and is, for example, a sheet with a very rough surface or embossed paper.

A transfer mechanism of a conventional image formation apparatus is described here. FIG. 1 illustrates an example of a transfer mechanism of the conventional image formation apparatus.

In the transfer mechanism illustrated in FIG. 1, photoreceptors 232Y, 232M, 232C, and 232K carrying yellow, magenta, cyan, and black electrostatic latent images, respectively are arranged along a rotating direction (clockwise direction) of an intermediate transfer belt 241. Primary transfer members 242Y, 242M, 242C, and 242K are disposed for the respective colors to face the photoreceptors 232Y, 232M, 232C, and 232K through the intermediate transfer belt 241. The primary transfer member press the intermediate transfer belt 241 against the photoreceptors in contact with the intermediate transfer belt 241. Through the intermediate transfer belt 241, a secondary transfer member 261 is disposed to face a counter member 243 inside the intermediate transfer belt 241.

A cleaning member 248 is disposed on a downstream side of the intermediate transfer belt 241 in a belt rotating direction of the secondary transfer member 261. On the intermediate transfer belt 241, a position on the downstream side of the photoreceptor 232Y is a position A, a position on the downstream side of the photoreceptor 232M is a position B, a position on the downstream side of the photoreceptor 232C is a position C, and a position on the downstream side of the photoreceptor 232K is a position D.

FIG. 2 is a graph expressing the toner adhesion force at each position on the intermediate transfer belt 241. As the toner adhesion force, a toner surface of an intermediate transfer belt 41 where the toner image is transferred is sprayed with air and the remaining amount of toner after the air spraying is measured.

In the example of FIG. 2, the adhesion force of the toner included in the toner image transferred to the intermediate transfer belt 241 increases as the multiple transfer of the toner image progresses in the order of the position A, the position B, the position C, and the position D. This is because, when the toner image of one color passes a primary transferor (primary transfer nip part) of another color, the toner of the toner image is pressed against the surface of the intermediate transfer belt 241 between the photoreceptor and the intermediate transfer belt 241. As the toner image passes the primary transferor of each color, the toner adhesion force to the surface of the intermediate transfer belt 241 increases. That is to say, as the measurement position is more on the downstream side of the intermediate transfer belt 241, the toner image transferred to the intermediate transfer belt 241 passes the primary transferor more times; thus, the toner adhesion force increases.

A sheet with high flatness and almost no unevenness on a surface, for example plain paper, is in close contact with the surface of the intermediate transfer belt where the toner image is transferred (this surface is hereinafter referred to as "toner surface"); thus, a sufficient electric field is obtained and the toner adhesion force is hardly affected. However, in a case of uneven paper, a sufficient electric field is not obtained between a concave part and the toner surface; thus, the toner adhesion force is easily affected.

For example, JP 2014-010383 A discloses an image formation apparatus that can obtain a sufficient image concentration in a concave part of a surface of a recording medium by a method that applies no burden. A transfer unit according to JP 2014-010383 A includes an intermediate transfer belt, a secondary transfer back-surface roller, and a secondary transfer bias power source. The secondary transfer bias power source applies to the secondary transfer back-surface roller, a transfer bias in which an alternating-current voltage and a direct-current voltage are overlapped. At least one layer of the intermediate transfer belt is an elastic layer.

Incidentally, in the technique according to JP 2014-010383 A, the alternating-current voltage is applied to the secondary transferor. When the alternating-current voltage is applied to the secondary transferor simply, an image noise (image failure) occurs, for example, a part of the toner on the sheet scatters as letter dust (also referred to as toner dust).

SUMMARY

The present invention has been made in view of the above circumstances, and an object thereof is to improve the transfer property of toner to uneven paper while suppressing an image noise such as letter dust.

To achieve the abovementioned object, according to an aspect of the present invention, an image formation apparatus reflecting one aspect of the present invention comprises: a plurality of image formers each of which is provided for each color and forms a toner image; a plurality of image carriers each of which is provided in accordance with each of the image formers and carries the toner image formed by each image former; a first intermediate transfer body on which multiple toner images are formed in a manner that the toner images of at least two colors that are carried by the plurality of image carriers are primarily transferred by primary transferors; a secondary transferor that secondarily transfers to a sheet, the multiple toner images formed on the first intermediate transfer body; and an adhesion force reducer that is provided between a position where the multiple toner images are formed on the first intermediate transfer body and a secondary transfer position of the secondary transferor and that reduces an adhesion force of toner included in the multiple toner images formed on the first intermediate transfer body.

BRIEF DESCRIPTION OF THE DRAWINGS

Other object, structure, and effect than those described above will become more fully understood from the detailed description of one or more embodiments of the invention given hereinbelow and the appended drawings which are given by way of illustration only, and thus are not intended as a definition of the limits of the present invention:

FIG. 5 is a table showing a material and setting values of each component of the transfer mechanism according to the first embodiment of the present invention;

FIG. 7 is a graph expressing a toner adhesion force at each position on an intermediate transfer belt according to the first embodiment of the present invention;

FIG. 8 is a table showing a material and setting values of each component of a transfer mechanism according to a comparative example;

FIG. 11 is a table showing a material and setting values of each component of the transfer mechanism according to the second embodiment of the present invention;

FIG. 17A and FIG. 17B each show an example of application voltage to a voltage application member according to the fourth embodiment of the present invention, in which FIG. 17A shows an example of a sine wave and FIG. 17B shows an example of a rectangular wave;

FIG. 18 is an explanatory view showing a result of auto transfer voltage control (ATVC) and an environment according to the fourth embodiment of the present invention;

FIG. 23 is a paper width correction table expressing a relation between a basis weight and a paper width according to a sixth embodiment of the present invention.

DETAILED DESCRIPTION OF EMBODIMENTS

Hereinafter, examples of embodiments of the present invention will be described with reference to the drawings. However, the scope of the invention is not limited to the disclosed embodiments. Throughout the drawings, the components with substantially the same function or structure are denoted by the same reference sign and the redundant description is omitted. Note that the attached drawings illustrate the specific embodiments and examples in accordance with the principle of the present invention and are used to help the understanding of the present invention, and these drawings will not be used to restrictively construe the present invention.

1. First Embodiment

In a first embodiment, a toner adhesion force is reduced by transferring a toner image temporarily to another image carrier (second intermediate transfer body) on an upstream side of a secondary transfer position, and then the images are collectively transferred from the image carrier to a sheet. That is to say, the toner image is transferred to the second intermediate transfer body before a secondary transfer.

Figure 3:
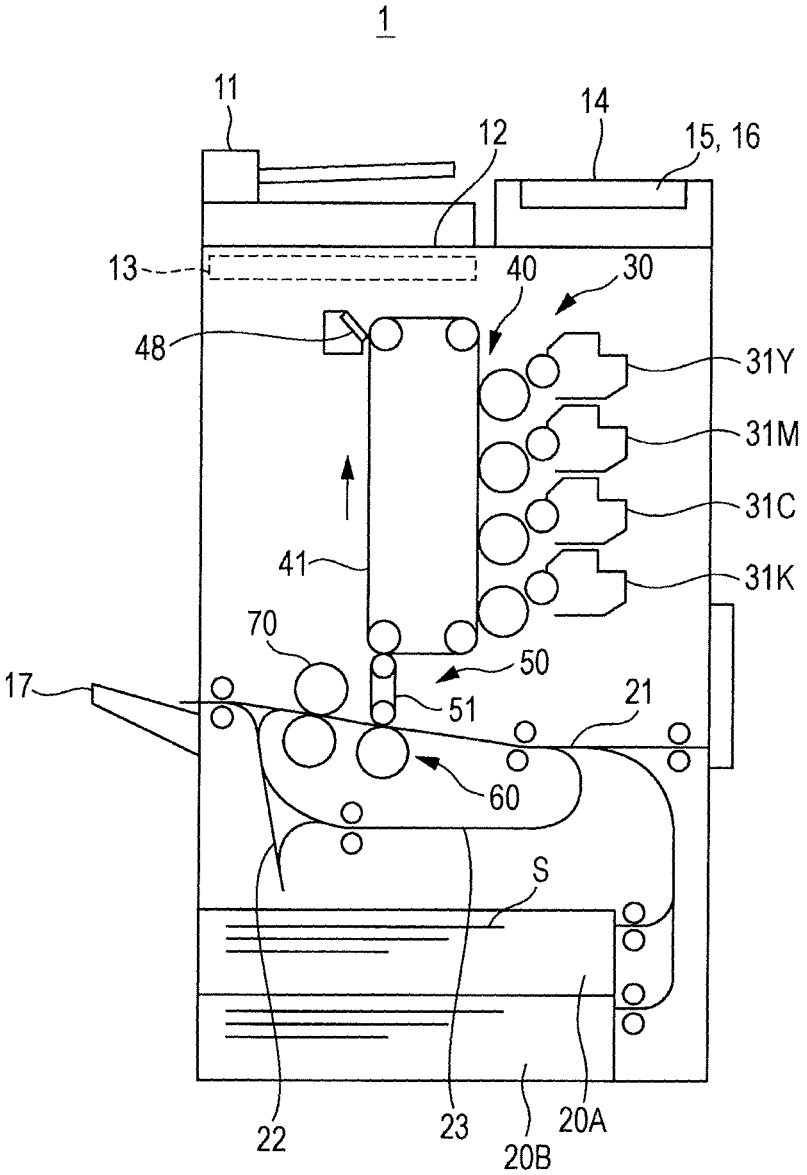
FIG. 3 is a schematic cross-sectional view illustrating an entire structure of an image formation apparatus according to a first embodiment of the present invention.

FIG. 3 is a schematic cross-sectional view illustrating an entire structure of an image formation apparatus according to the first embodiment of the present invention.

An image formation apparatus 1 employs an electrophotography method in which an image is formed using static electricity. The image formation apparatus 1 is, for example, a tandem type color image formation apparatus in which toner images of four colors of yellow (Y), magenta (M), cyan (C), and black (K) are overlapped on each other. This image formation apparatus 1 includes paper feed trays 20A and 20B, an auto-document feeder (ADF) 11, a scanner 13, an image former 30, a primary transferor 40, an adhesion force reducer 50, a secondary transferor 60, a fixing part 70, and an operation display panel 14.

The paper feed trays 20A and 20B contain sheets such as plain paper or embossed paper (one example of uneven paper) depending on what to print. The paper feed trays 20A and 20B are referred to as the paper feed tray 20 unless discrimination is necessary. The image formation apparatus 1 includes a conveyance path 21 for conveying sheets S fed from the paper feed tray 20. The conveyance path 21 is provided with a plurality of rollers (conveyance rollers) for conveying the sheets S.

The auto-document feeder 11 conveys document set on a document feeding table one by one to a reading position of the scanner 13, that is, a top surface of a platen glass 12 (document table) by a plurality of rollers and conveyance drums that are not shown. In addition, the auto-document feeder 11 discharges the document conveyed by a document discharge roller to a document discharge tray of the auto-document feeder 11.

The image former 30 includes four image formation units 31Y, 31M, 31C, and 31K (one example of image formers) that are arranged along a rotating direction (clockwise) indicated by an upward arrow of an intermediate transfer belt 41 in order to form the toner images of the yellow, magenta, cyan, and black. The image formation units 31Y, 31M, 31C, and 31K are referred to as "image formation unit 31" unless discrimination is necessary. Each image formation unit 31 includes a charging part, an exposure part such as a laser light source, a development part, and a photoreceptor (see FIG. 4 to be described below).

The primary transferor 40 includes the intermediate transfer belt 41 that is endless (one example of the first intermediate transfer body). To the intermediate transfer belt 41, the toner images formed on the photoreceptors of the image formation units 31Y, 31M, 31C, and 31K are transferred. To the intermediate transfer belt 41, the toner images of the respective colors are primarily transferred (multiple-transferred) with the positions aligned, and thus, the multiple toner images with the mixed colors (color image) are formed.

The adhesion force reducer 50 is disposed between a position where the multiple toner images are formed on the intermediate transfer belt 41 and the secondary transfer position of the secondary transferor 60. The adhesion force reducer 50 includes an intermediate transfer belt 51 to which the multiple toner images transferred to the intermediate transfer belt 41 are transferred, and has a function of reducing the adhesion force of the toner included in the multiple toner images formed on the intermediate transfer belt 41. The adhesion force reducer 50 will be described in detail with reference to FIG. 4.

On a downstream side of the belt rotating direction of a nip part (secondary transfer position) formed by the intermediate transfer belt 41 and the intermediate transfer belt 51 of the adhesion force reducer 50, a cleaning member 48 is disposed. With the use of a blade or the like, the cleaning member 48 removes the toner remaining on the surface of the intermediate transfer belt 51 after the secondary transfer.

In an image formation mode, the image formation apparatus 1 charges the photoreceptor with a drum shape in each of the image formation units 31Y, 31M, 31C, and 31K and moreover exposes a surface of each photoreceptor in accordance with a document image, and thus forms an electrostatic latent image on the photoreceptor. Then, the development part causes the toner to adhere to the electrostatic latent image of the photoreceptor for each of yellow, magenta, cyan, and black; thus, the toner images of the respective colors are formed. Next, the toner images formed on the photoreceptors of yellow, magenta, cyan, and black are sequentially primarily transferred (multiple-transferred) on the surface of the intermediate transfer belt 41 that is rotated and driven. The intermediate transfer belt 41 is one example of the intermediate transfer body.

The secondary transfer member 61 (hereinafter referred to as "second secondary transfer member") has a roller shape, and secondarily transfers the multiple toner images, which have been transferred from the intermediate transfer belt 41 to the intermediate transfer belt 51 of the adhesion force reducer 50, to the sheet S that is fed. When the toner images of the respective colors on the intermediate transfer belt 41 are secondarily transferred to the sheet S, a color image is formed. The image formation apparatus 1 conveys the sheet S with the color toner image formed thereon to the fixing part 70.

The fixing part 70 is a device that performs a fixing process on the sheet S with the color toner image formed thereon that is fed from the image formation apparatus 1. The fixing part 70 fixes the transferred toner image to the sheet S by applying pressure or heat to the conveyed sheet S. The fixing part 70 includes, for example, a fixing upper roller and a fixing lower roller corresponding to fixing members. The fixing upper roller and the fixing lower roller are disposed in a manner that both rollers are in pressure contact with each other, and a fixing nip part is formed as a pressure-contact part of the fixing upper roller and the fixing lower roller.

In the fixing upper roller, a heating part that is not shown is provided. By a radiant heat from the heating part, a roller part at an outer periphery of the fixing upper roller is warmed. The sheet S is conveyed to a fixing nip part so that the surface to which the toner image is transferred by the secondary transferor 60 (fixing target surface) faces the fixing upper roller. To the sheet S passing the fixing nip part, pressure is applied by the fixing upper roller and the fixing lower roller and heat is applied by the roller part of the fixing upper roller. The sheet S on which the fixing process has been performed by the fixing part 70 is discharged to a paper discharge tray 17.

The conveyance path 21 connects to an inverse conveyance path 23 that is branched on the downstream side of the fixing part 70 and combined to the conveyance path 21 on the upstream side of the secondary transferor 60. The inverse conveyance path 23 is provided with an inversion part 22 that inverts the sheet S. The inversion part 22 inverts the sheet S conveyed from the fixing part 70 and conveys the sheet S to the conveyance path 21 on the upstream side of the secondary transferor 60 through the inverse conveyance path 23. The inversion part 22 can also return the inverted sheet S back to the conveyance path 21 on the downstream side of the fixing part 70 and convey the sheet S directly to the paper discharge tray 17.

On an upper part of the image formation apparatus 1, the operation display panel 14 is disposed. The operation display panel 14 accepts a printing operation a setting change, and displays various kinds of information. The operation display panel 14 includes a display part 15 that displays information, and an operation part 16 that instructs, for example, to start a job of an image formation process. The display part 15 includes, for example, a liquid crystal display (LCD) panel. The operation part 16 includes a touch panel to which an input is possible by a touch operation, and the touch panel is stacked on the LCD panel of the display part 15. Note that the operation part 16 may be formed of a mouse, a keyboard, a tablet, or the like and may be structured separate from the display part 15.

[Adhesion Force Reducing Part]

Figure 4:
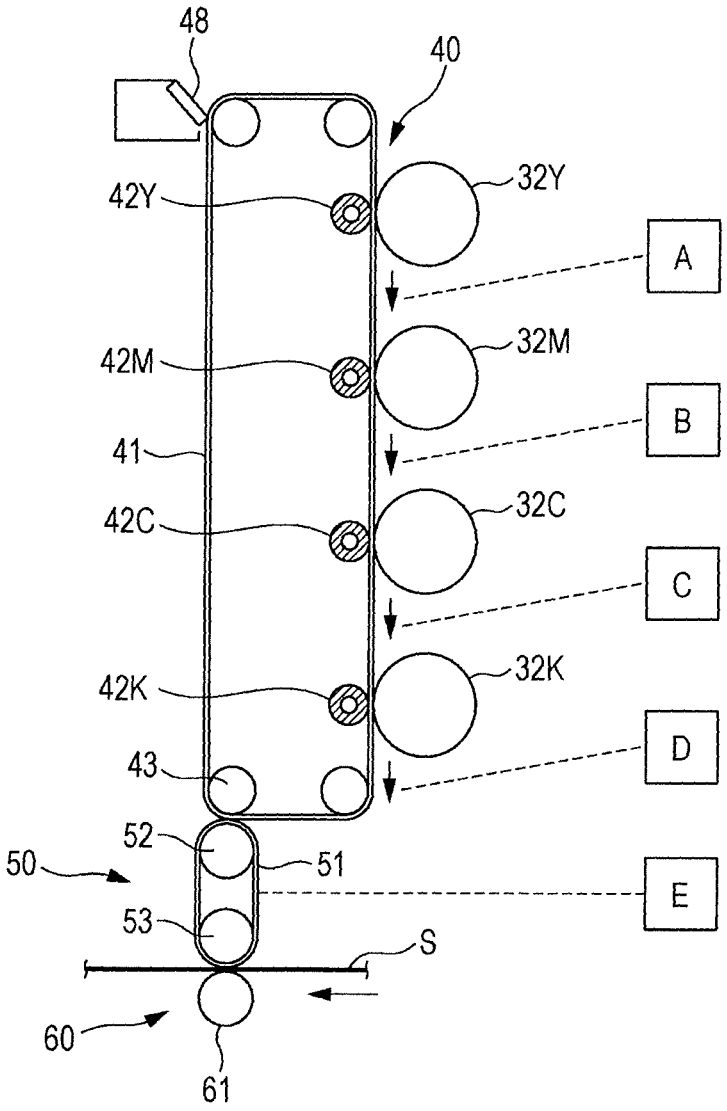
FIG. 4 is an explanatory view illustrating a structure example of a transfer mechanism including an adhesion force reducer according to the first embodiment of the present invention.

FIG. 4 illustrates a structure example of a transfer mechanism including the adhesion force reducer 50.

The transfer mechanism illustrated in FIG. 4 includes four photoreceptors 32Y, 32M, 32C, and 32K (image carriers) provided in accordance with the image formation units 31Y, 31M, 31C, and 31K, respectively. The photoreceptors 32Y, 32M, 32C, and 32K carry toner images formed by the image formation units 31Y, 31M, 31C, and 31K. The photoreceptors 32Y, 32M, 32C, and 32K are disposed along the rotating direction indicated by arrows on the intermediate transfer belt 41 and carry yellow, magenta, cyan, and black toner images, respectively. In the transfer mechanism, primary transfer members 42Y, 42M, 42C, and 42K of the respective colors are disposed as components of the primary transferor 40 so as to face the photoreceptors 32Y, 32M, 32C, and 32K with the intermediate transfer belt 41 interposed therebetween. The primary transfer members 42Y, 42M, 42C, and 42K press the intermediate transfer belt 41 against the photoreceptors 32Y, 32M, 32C, and 32K in contact with the intermediate transfer belt 41. The primary transfer members 42Y, 42M, 42C, and 42K are referred to as "primary transfer member 42" unless discrimination is necessary.

On the downstream side of the secondary transfer member 61 in the rotating direction of the intermediate transfer belt 41, the cleaning member 48 is disposed. On the intermediate transfer belt 41, a position on the downstream side of the photoreceptor 32Y is a position A, a position on the downstream side of the photoreceptor 32M is a position B, a position on the downstream side of the photoreceptor 32C is a position C, and a position on the downstream side of the photoreceptor 32K is a position D. In addition, a position on the upstream side of the secondary transfer position by the second secondary transfer member 61 on the intermediate transfer belt 51 of the adhesion force reducer 50 is a position E.

The adhesion force reducer 50 is disposed between a position where the multiple toner images are formed on the intermediate transfer belt 41 and the secondary transfer position (secondary transfer nip part) of the secondary transferor 60. In FIG. 4, the adhesion force reducer 50 is disposed between the secondary transferor 60 and the downstream side of the black photoreceptor 32K. The adhesion force reducer 50 includes the intermediate transfer belt 51 that is endless, a first secondary transfer member 52, and a second counter member 53. The intermediate transfer belt 51 is one example of the second intermediate transfer body, and is wound around the first secondary transfer member 52 and the second counter member 53. The first secondary transfer member 52 is disposed to face a counter member 43 (hereinafter referred to as "first counter member 43") on the inside of the intermediate transfer belt 41 with the intermediate transfer belt 41 interposed between the first secondary transfer member 52 and the counter member 43. The second counter member 53 is disposed to face the secondary transfer member 61 through the intermediate transfer belt 51.

[Material and Setting Value of Each Component of Transfer Mechanism]

FIG. 5 shows a material and setting values of each component of the transfer mechanism according to the first embodiment.

The system speed (also referred to as process speed) of the image formation apparatus 1 is, for example, 400 mm/sec. The intermediate transfer belt 41 corresponding to the first intermediate transfer body is formed of, for example, polyimide resin, and has a thickness of 80 μm and a surface resistance of 11 log Ω/square. The primary transfer member 42 is formed using, for example, a nitrile-butadiene rubber (NBR) sponge rubber roller, and has a resistance of 7.5 log Ω, a hardness of Asker-C 35°, an outer diameter of φ20 mm, and a pressing force of 10 N. The sponge rubber roller is formed by providing a sponge rubber on a surface of a metal roller. The structure of the primary transfer member 42 is common among the respective colors. The first counter member 43 is formed using, for example, an NBR sponge rubber roller, and has a resistance of 7.5 log Ω, a hardness of Asker-C 30°, an outer diameter of φ38 mm, and a pressing force of 10 N.

The intermediate transfer belt 51 as the second intermediate transfer body is formed of, for example, polyimide resin, and has a thickness of 80 μm and a surface resistance of 11 log Ω/square. The first secondary transfer member 52 is formed using, for example, an NBR solid rubber roller, and has a resistance of 7.5 log Ω, a hardness of Asker-C 60°, and an outer diameter of φ38 mm. The solid rubber roller is formed by providing solid rubber on a surface of a metal roller. Solid rubber is a resin that is harder than sponge including foams and having flexibility, and is formed by rubber containing ceramic particles. The second counter member 53 is formed using, for example, an NBR sponge rubber roller, and has a resistance of 7.5 log Ω, a hardness of Asker-C 30°, an outer diameter of φ38 mm, and a pressing force of 10 N.

FIG. 5 shows one example, and the specification of each component is not limited to this example. For example, although the intermediate transfer belt 41 and the intermediate transfer belt 51 are formed of the same material, the belts may be formed of different materials. Examples of the different materials include polyamide resin, polyamide-imide resin, and polyvinylidene fluoride resin (PVDF resin). Each transfer member may be formed of other materials than NBR.

[Control System of Image Formation Apparatus]

Figure 6:
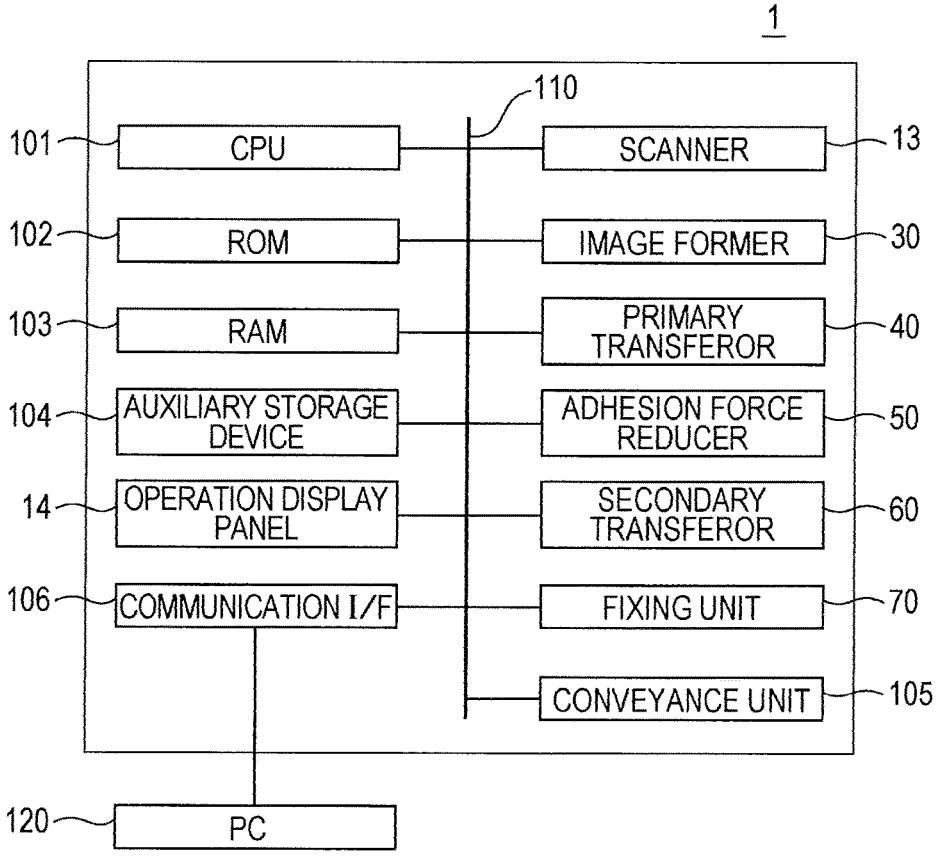
FIG. 6 is a block diagram illustrating a hardware structure example of the image formation apparatus according to the first embodiment of the present invention.

FIG. 6 illustrates a hardware structure example of the image formation apparatus 1.

The image formation apparatus 1 includes a central processing unit (CPU) 101, a read only memory (ROM) 102, a random access memory (RAM) 103, an auxiliary storage device 104, the scanner 13, the image former 30, the primary transferor 40, the adhesion force reducer 50, the secondary transferor 60, the fixing part 70, a conveyance part 105, the operation display panel 14, and a communication interface 106 (in the drawing, communication I/F). These components are connected to each other through a bus 110 so that the data can be exchanged.

The CPU 101 (one example of control unit) is a calculation processor that performs a control of each part of the image formation apparatus 1 and various calculation processes. The CPU 101 reads out program codes (hereinafter referred to as "programs") of software for achieving each function of the present embodiment from the ROM 102 or the auxiliary storage device 104, and executes the programs. Note that the image formation apparatus 1 may include other calculation processor than the CPU, for example a microprocessing unit (MPU).

The ROM 102 (one example of storage part) is a non-volatile recording medium that stores various programs and various data to achieve the functions of the image formation apparatus 1. For example, the ROM 102 stores information related to a plurality of front-back adjustment methods for various ranges of conveyance-direction lengths. The ROM 102 moreover records setting information of each paper feed tray, a characteristic of each front-back adjustment method, and a display rule for the adjustment method.

The RAM 103 (main storage device) stores programs and data temporarily as a work area. For example, in the RAM 103, various data including parameters, variables, and the like that are generated in the middle of the calculation process by the CPU 101 are temporarily written.

The auxiliary storage device 104 (one example of the storage part) is a storage device that plays a role of assisting the RAM 103, and usually has a structure in which long-time data or large-capacity data can be saved. In addition to an operating system and various parameters, this auxiliary storage device 104 may record various programs to enable the image formation apparatus 1 to function. For example, the auxiliary storage device 104 saves various image data and the like of a setting screen, an input screen, and the like. Instead of the ROM 102, the auxiliary storage device 104 may record the setting information and the like of each paper feed tray. The auxiliary storage device 104 may use a hard disk, a solid state drive (SSD), a flexible disk, an optical disk, a magneto-optic disk, a CD-ROM, a CD-R, a magnetic tape, a non-volatile memory card, or the like.

The scanner 13 (one example of image input part) reads an image of document conveyed to a top surface of the platen glass 12 by the auto-document feeder 11 or document placed on the platen glass 12, generates read data (image data), and outputs the data to the CPU 101. Although the scanner 13 is provided inside the image formation apparatus 1, the scanner 13 may be provided outside the image formation apparatus 1 and the data read by the scanner 13 may be transmitted to the image formation apparatus 1 through a dedicated line or the like.

The conveyance part 105 conveys the sheet S by driving the conveyance rollers provided to the conveyance path 21, and the conveyance rollers provided to the inversion part 22 and the inverse conveyance path 23 under the control of the CPU 101.

The CPU 101 receives an operation signal from the operation part 16 of the operation display panel 14, and performs a control in accordance with the operation signal. The CPU 101 outputs a display signal to the operation display panel 14, and the operation display panel 14 displays the operation screen in the display part 15. The operation screen displays various setting screens to input various operation instructions and setting information, various process results, and the like.

The communication I/F 106 is an interface to exchange data with a personal computer (PC) 120 corresponding to an operation terminal through a network or a dedicated line. The communication I/F 106 is, for example, a network interface card (NIC).

Description is made of a normal operation (print operation) of forming an image on the sheet S by the image formation apparatus 1. First, the CPU 101 controls the conveyance part 105 to feed and convey the sheet S. Based on the image data obtained from the document through the scanner 13 or the image data obtained from the PC 120 or the like, the CPU 101 controls the image former 30 to perform image formation, and transfers the multiple toner images (color image) to the intermediate transfer belt 41 by the primary transferor 40. Then, the CPU 101 transfers the multiple toner images transferred to the intermediate transfer belt 41 to the intermediate transfer belt 51 of the adhesion force reducer 50, and then transfers the multiple toner images from the intermediate transfer belt 51 to the sheet S. Then, the CPU 101 controls the fixing part 70 to perform the process of fixing the toner image on the sheet S and the sheet S is discharged to the paper discharge tray 17.

[Result of Measuring Toner Adhesion Force]

FIG. 7 is a graph expressing the toner adhesion force at each position on the intermediate transfer belt 41.

The adhesion force reducer 50 was operated to implement the function of reducing the toner adhesion force and then, the toner surface of the intermediate transfer belt 41 to which the toner image has been transferred was sprayed with air. On the basis of the remaining amount of toner after the air spraying, the toner adhesion force was determined. As the remaining amount of toner on the toner surface, the toner concentration was measured by a concentration sensor. As the toner adhesion force is higher, the remaining amount of toner on the toner surface is larger.

In the example of FIG. 7, the adhesion force of the toner of the toner image transferred to the intermediate transfer belt 41 increases as the multiple transfer of the toner image progresses in the order of the position A, the position B, the position C, and the position D. However, at the position E on the intermediate transfer belt 51, the toner adhesion force is smaller than that at the position A. That is to say, since the toner image on the intermediate transfer belt 41 is transferred temporarily to another intermediate transfer belt 51 before the secondary transfer, the toner adhesion force is low as compared with the case in which the magenta toner image is transferred.

[Result of Comparing with Comparative Example in Regard to Image Quality]

Figures 9, 10:
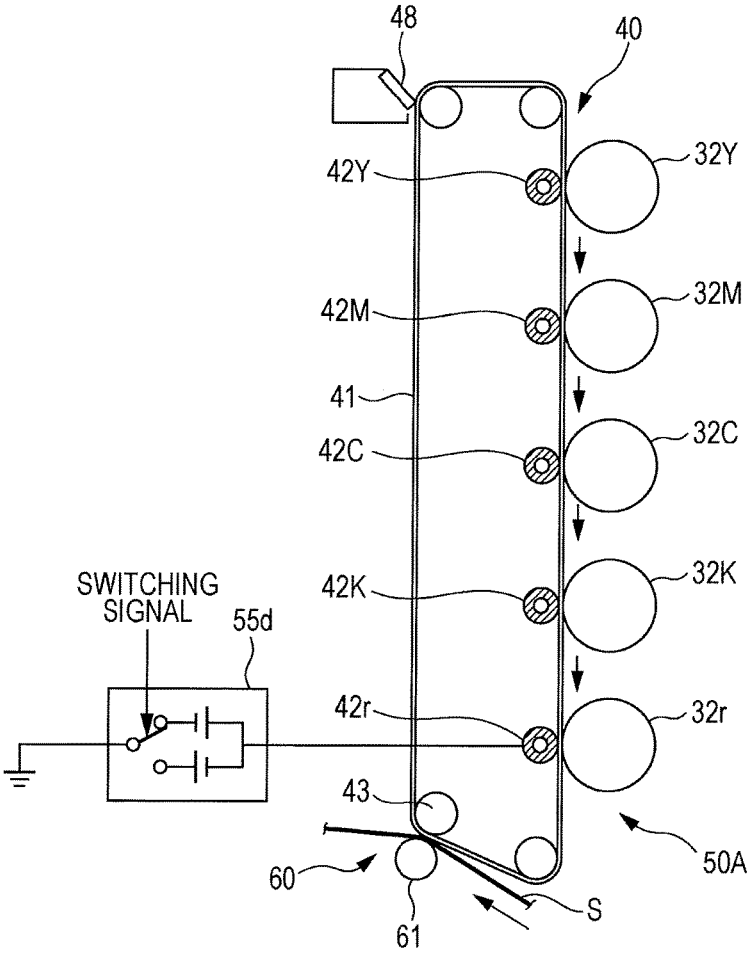
FIG. 9 is a table expressing results of evaluating the transfer property to embossed paper by using the transfer mechanism according to the first embodiment of the present invention and the transfer mechanism according to the comparative example.
FIG. 10 is an explanatory view illustrating a structure example of a transfer mechanism including an adhesion force reducer according to a second embodiment of the present invention.

Description is made of a result of comparing the present embodiment with a transfer mechanism not including the adhesion force reducer in regard to the image quality with reference to FIG. 8 and FIG. 9. The present embodiment is compared with the transfer mechanism with the structure illustrated in FIG. 1.

Figure 1:
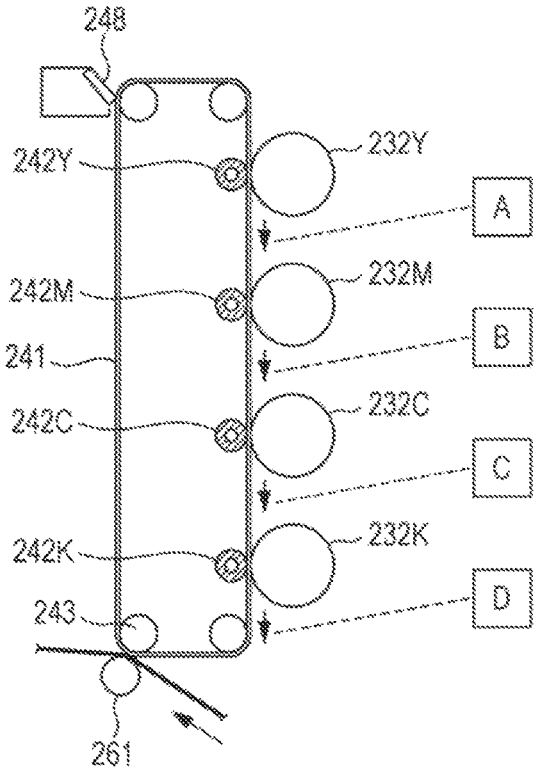
FIG. 1 PRIOR ART
FIG. 1 is an explanatory view illustrating an example of a transfer mechanism of a conventional image formation apparatus.
Figure 2:
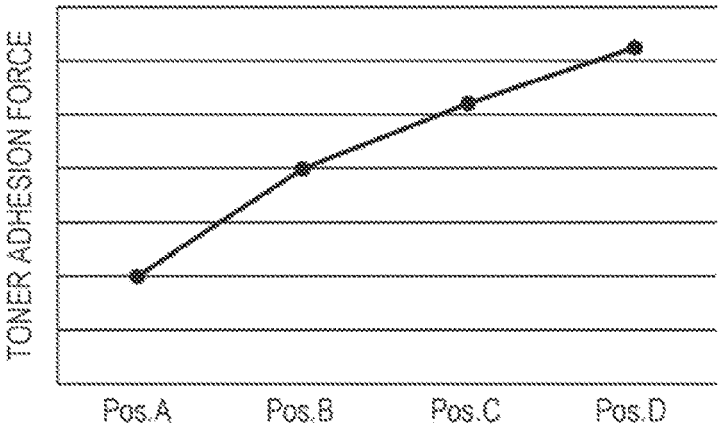
FIG. 2 is a graph expressing a toner adhesion force at each position on a conventional intermediate transfer belt.

FIG. 8 shows a material and setting values of each component of the transfer mechanism of the conventional image formation apparatus illustrated in FIG. 1.

The system speed of the conventional image formation apparatus 1 is, for example, 400 mm/sec, which is the same as that of the image formation apparatus 1. The intermediate transfer belt 241 corresponding to the first intermediate transfer body of the image formation apparatus 1 is formed of, for example, polyimide resin, and has a thickness of 80 μm and a surface resistance of 11 log Ω/square. The primary transfer member 242 is formed of, for example, an NBR sponge rubber roller, and has a resistance of 7.5 log Ω, a hardness of Asker-C 35°, an outer diameter of φ20 mm, and a pressing force of 10 N. The structure of the primary transfer member 242 is common among the respective colors. The counter member 43 corresponding to the first counter member in FIG. 8 is formed using a roller of an NBR sponge rubber+a solid rubber and has a resistance of 7.5 log Ω, a hardness of Asker-C 45°, an outer diameter of φ38 mm, and a pressing force of 80 N.

FIG. 9 is a table expressing results of evaluating the transfer property to embossed paper as the uneven paper by using the transfer mechanism of the image formation apparatus 1 and the transfer mechanism of the comparative example (FIG. 1).

The embossed paper used for the measurement is embossed LEATHAC white 302 gsm with a leather-like pattern. In this measurement, comparison was performed in regard to toner images of halftone (intermediate concentration) transferred from the yellow photoreceptors 32Y and 232Y, toner images of a solid image (one-layer solid printing) transferred from the yellow photoreceptors 32Y and 232Y, and toner images of a solid image (two-layer solid printing) transferred from the yellow photoreceptors 32Y and 232Y and the magenta photoreceptors 32M and 232M. The toner images of the halftone is the multiple toner images after being transferred from the photoreceptors 32Y, 32M, 32C, and 32K (232Y, 232M, 232C, and 232K). The transfer property was evaluated depending on whether a void is seen with eyes. A concave part where the toner does not exist or the toner does not adhere well on the sheet is determined to be a void.

As shown in FIG. 9, in the structure of the first embodiment, excellent results (⊙ mark) were obtained in regard to the toner images of the halftone and the toner images of the one-layer solid printing. A good result (○ mark) was obtained in regard to the toner image of the two-layer solid printing. On the other hand, in the structure of the comparative example, the result of the toner image of the halftone was below average (Δ mark) and the results of the toner images of the one-layer solid printing and two-layer solid printing were poor (× mark). The similar tendency was observed in regard to other embossed paper.

In the first embodiment described above, the adhesion force reducer 50 including the intermediate transfer belt 51 (one example of image carrier) is provided between the intermediate transfer belt 41 and the second secondary transfer member 61 that transfers the toner image to the sheet S. Before the secondary transfer, the adhesion force reducer 50 transfers the toner images (multiple toner images) on the intermediate transfer belt 41 to the intermediate transfer belt 51, and after that, the secondary transferor 60 transfers collectively the toner images from the intermediate transfer belt 51 to the sheet S. In this manner, by temporarily transferring the multiple toner images from the intermediate transfer belt 41 to another transfer body (intermediate transfer belt 51) before the secondary transfer and then transferring the toner images to the sheet S collectively, the adhesion force of the toner to the belt surface can be reduced regardless of the toner color. Accordingly, the transfer property of the toner image to the uneven paper such as embossed paper in the secondary transferor 60 can be improved.

In the present embodiment, the alternating-current voltage is not applied to the secondary transferor, which is different from the technique according to JP 2014-010383 A. Thus, the image noise (image failure) such as the letter dust does not occur, and a certain level of image quality can be maintained also from this perspective.

The pressing force (10 N) of the first counter member 43 illustrated in FIG. 5 is the same as that of the primary transfer member 42. In the present embodiment, since the adhesion force of the toner to the belt surface can be reduced, the pressing force of the first counter member 43 can be set lower (for example, 8 N) than the pressing force of the primary transfer member 42 (10 N in FIG. 5). In this case, in a first secondary transfer nip part between the first counter member 43 and the first secondary transfer member 52, the width of the nip part (the length in a circumferential direction of the roller) increases and the peak value of the pressing force decreases. As a result, the pressing force of the toner to the belt surface becomes smaller. Conversely, the excellent transfer property is maintained even if the pressing force of the first counter member 43 is reduced.

As illustrated in FIG. 5, the hardness of the first counter member 43 (Asker-C 30°) may be smaller than the hardness of the primary transfer member 42 (Asker-C 35°). As illustrated in FIG. 5, the hardness of the first counter member 43 (Asker-C 30°) may be smaller than the hardness of the first counter member (Asker-C 45°) that is illustrated in FIG. 8 (comparative example). Thus, in a manner similar to the case of the pressing force described above, in the first secondary transfer nip part between the first counter member 43 and the first secondary transfer member 52, the width of the nip part (the length in the circumferential direction of the roller) increases and the peak value of the pressing force decreases. As a result, the pressing force of the toner to the belt surface becomes smaller.

The concept and effect in regard to the pressing force and the hardness of the transfer member used on the downstream side of the primary transfer step are common in second to fifth embodiments to be described below. For example, in the fourth embodiment, the pressing force of a voltage application member 42*r* is 5 N, which is a half of a pressing force of 10 N of the primary transfer member 42.

Incidentally, in a case where the toner adhesion force is reduced by reducing the primary transfer pressing force, a transfer failure at the primary transferor or an image failure such as an image noise easily occurs when thick paper such as embossed paper enters the secondary transfer nip part (hereinafter such an image noise is also referred to as "thick paper shock noise"). On the other hand, in the first embodiment, the adhesion force of the toner of the toner image transferred to the intermediate transfer belt 41 is reduced without reducing the primary transfer pressing force; therefore, the toner adhesion force can be reduced while suppressing these image failures.

2. Second Embodiment

In a second embodiment, a toner image is transferred temporarily from an intermediate transfer body to another image carrier (second image carrier) before the secondary transfer, and then the toner image is transferred again to the intermediate transfer body. That is to say, in the present embodiment, the second image carrier that is not involved in image formation is provided between the secondary transfer member 61 and the most downstream side of the image formation step (primary transferor 40).

[Adhesion Force Reducing Part]

FIG. 10 illustrates a structure example of a transfer mechanism including an adhesion force reducer according to the second embodiment.

As illustrated in FIG. 10, the transfer mechanism according to the present embodiment includes an adhesion force reducer 50A between the secondary transfer member 61 and the photoreceptor 32K on the most downstream side of the image formation step instead of the intermediate transfer belt 51 (FIG. 4).

The adhesion force reducer 50A includes a photoreceptor 32*r* corresponding to one example of the second image carrier, the voltage application member 42*r* with a roller shape, and a direct-current power source part 55*d*. The voltage application member 42*r* is disposed on the inside of the intermediate transfer belt 41 so as to face the photoreceptor 32*r* with the intermediate transfer belt 41 interposed therebetween. The photoreceptor 32*r* may have the same specification as that of the photoreceptor 32 with a drum shape that is used for forming the toner image of each color. The voltage application member 42*r* may have the same specification as that of the primary transfer member 42 used for the primary transfer of the toner image of each color. The detailed specifications of the other components are the same as those in the first embodiment.

The adhesion force reducer 50A transfers the toner image which has been transferred to the inter mediate transfer belt 41, onto the photoreceptor 32*r* temporarily and then, after the photoreceptor 32*r* is rotated once, the toner image is transferred again to the intermediate transfer belt 41; thus, the toner adhesion force is reduced.

FIG. 11 shows a material and setting values of each component of an adhesion force reducer 50C of the transfer mechanism according to the fourth embodiment.

The material and setting of the intermediate transfer belt 41 (first intermediate transfer body) are the same as those of the first intermediate transfer body illustrated in FIG. 5. The material and setting of the primary transfer member 42 (common among the respective colors) are the same as those of the primary transfer member illustrated in FIG. 5. The counter member 43 is formed using, for example, a roller of an NBR sponge rubber+a solid rubber and has a resistance of 7.5 log Ω, a hardness of Asker-C 45°, an outer diameter of φ38 mm, and a pressing force of 80 N. The hardness and the pressing force of the counter member 43 are higher than those of the first counter member in the first embodiment. The secondary transfer member 61 is formed using, for example, an NBR solid rubber roller, and has a resistance of 7.5 log Ω, a hardness of Asker-C 70°, and an outer diameter of φ38 mm. The hardness of the secondary transfer member 61 is higher than that of the first secondary transfer member 52 in the first embodiment.

The material and setting of the photoreceptor 32*r* (electrostatic latent image carrier) of the adhesion force reducer 50C are the same as those of the other photoreceptors 32. The material and setting of the voltage application member 42*r* are almost the same as those of the primary transfer member 42, but the pressing force of the voltage application member 42*r* is 5 N, which is smaller than that of the primary transfer member 42.

In the present embodiment, the adhesion force of the toner to the belt surface can be reduced in a manner similar to the first embodiment. Therefore, the pressing force of the voltage application member 42*r* can be set lower (for example, 5 N) than the pressing force of the primary transfer member 42 (for example, 10 N). In this case, in a transfer nip part between the voltage application member 42*r* and the photoreceptor 32*r*, the width of the nip part (the length in the circumferential direction of the roller) increases and the peak value of the pressing force decreases. As a result, the pressing force of the toner to the belt surface becomes smaller. Conversely, the excellent transfer property is maintained even if the pressing force of the voltage application member 42*r* is reduced. In addition, since the wider nip part between the voltage application member 42*r* and the photoreceptor 32*r* results in a longer region of the transfer nip part where the toner vibrates, the toner adhesion force can be reduced. In addition, since the pressing force of the voltage application member 42*r* can be made lower than the pressing force of the primary transfer member 42 of each color, the toner easily vibrates in the transfer nip part and the toner adhesion force can be reduced.

In the example of FIG. 11, the hardness of the voltage application member 42*r* (Asker-C 35°) is the same as that of the other primary transfer members 42; however, since the adhesion force of the toner to the belt surface can be reduced in the present embodiment, the hardness of the voltage application member 42*r* can be lower (for example, Asker-C 30°) than that of the primary transfer member 42. Thus, in a manner similar to the case of the pressing force, in the transfer nip part between the voltage application member 42*r* and the photoreceptor 32*r*, the width of the nip part (the length in the circumferential direction of the roller) increases and the peak value of the pressing force decreases. As a result, the pressing force of the toner to the belt surface becomes smaller. In addition, since the hardness of the voltage application member 42*r* can be smaller than that of the primary transfer member 42 of each color, the toner vibrates more easily in the transfer nip and the toner adhesion force can be reduced.

In the present embodiment, an image formation unit that is not shown may be provided to form an electrostatic latent image on the photoreceptor 32*r*. This image formation unit includes, for example, a part of the structure of the image formation unit 31, and more specifically includes a charging part that charges the photoreceptor 32*r* and an exposure part such as a laser light source. When the photoreceptor 32*r* is provided with an electrostatic latent image corresponding to the image pattern of the toner image carried by the photoreceptor 32 of each color (Y, M, C, K) on the upstream side, the toner will not scatter out of the electrostatic latent image on the surface of the photoreceptor 32. Accordingly, the image noise such as toner dust can be prevented more certainly. In this case, the region on the surface of the photoreceptor 32*r* corresponding to the image pattern of the toner image is charged to have a polarity by which the toner is moved from the surface of the intermediate transfer belt 41.

Here, the voltage application member 42*r* of the second image carrier is grounded through the direct-current power source part 55*d*. The direct-current power source part 55*d* can output either a positive or negative direct-current voltage to the voltage application member 42*r*. The positive direct-current voltage and the negative direct-current voltage can be switched by using a relay, for example. By turning on or off a contact point in accordance with magnetization or non-magnetization of a coil of the relay, the positive direct-current voltage and the negative direct-current voltage are switched.

Figures 13, 14:
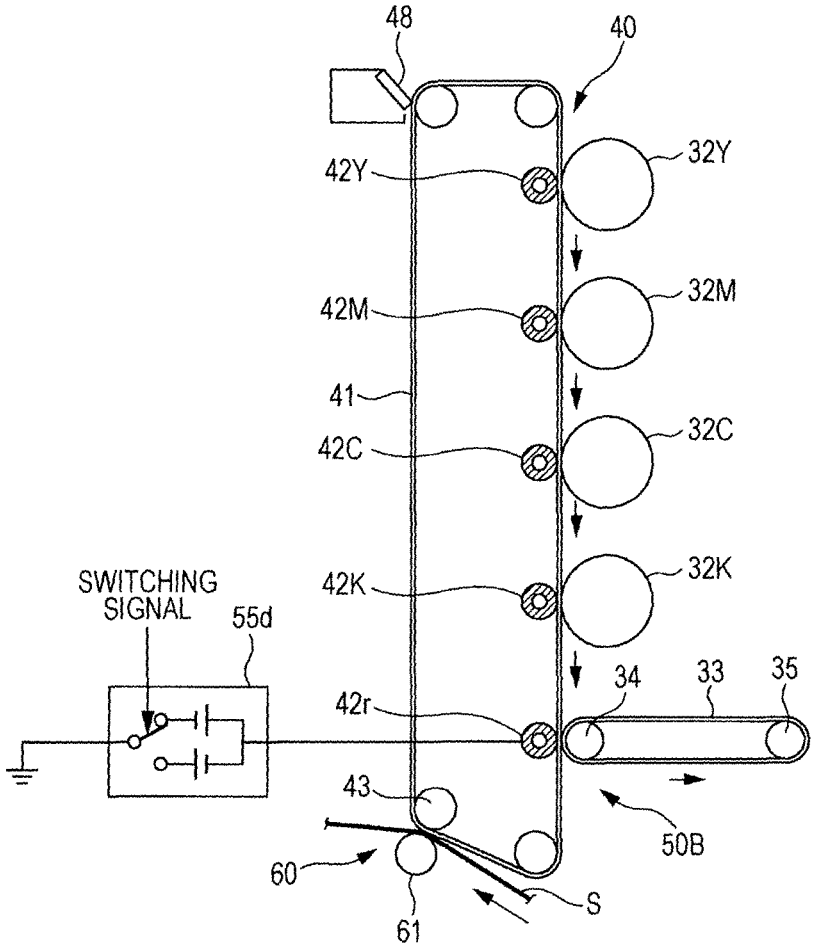
FIG. 13 is an explanatory view illustrating a structure example of a transfer mechanism including an adhesion force reducer according to a third embodiment of the present invention.
FIG. 14 is a table showing a material of a primary transfer counter member of the transfer mechanism according to the third embodiment of the present invention.

The photoreceptor 32*r* needs to have the circumferential length of such a degree that the toner image for the longest passable paper size can be transferred, and the photoreceptor 32*r* may be increased in diameter in accordance with the convenience for the machine. If it is difficult to increase the diameter of the photoreceptor 32*r* due to a space in the machine, a belt-shaped image carrier as illustrated in FIG. 13 to be described below or a conventional photosensitive belt may be used.

[Control System of Image Formation Apparatus]

Figure 12:
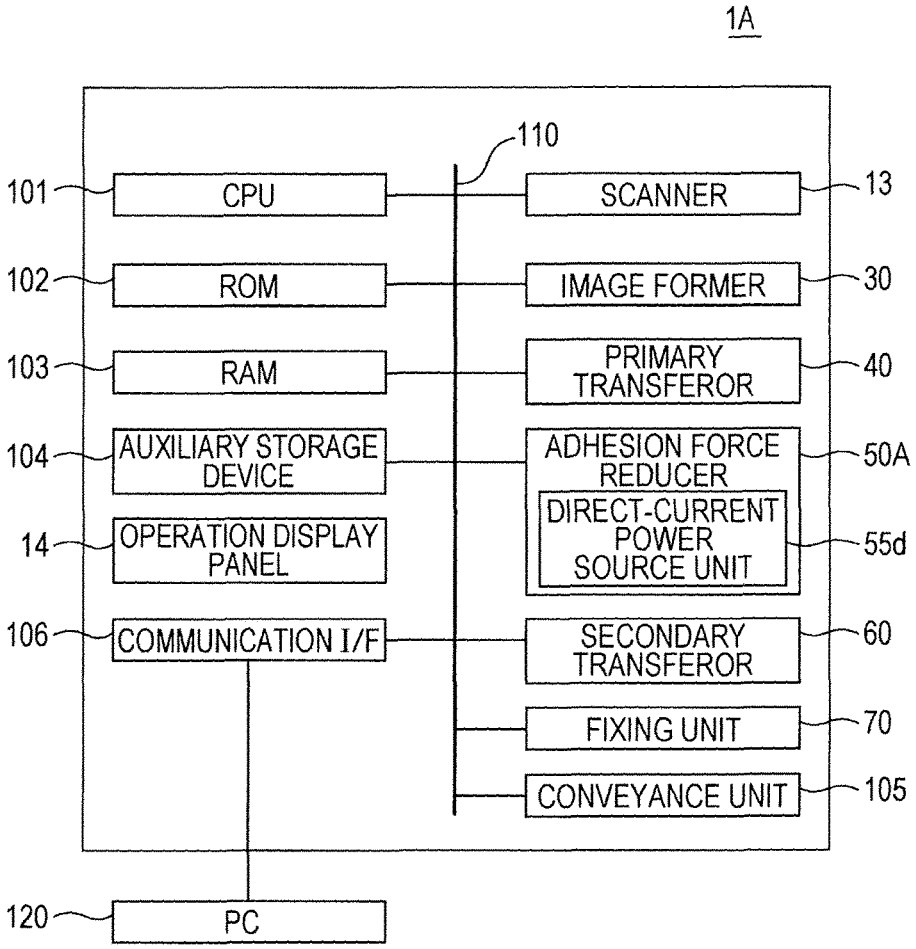
FIG. 12 is a block diagram illustrating a hardware structure example of an image formation apparatus according to the second embodiment of the present invention.

FIG. 12 illustrates a hardware structure example of an image formation apparatus 1A according to the second embodiment.

A control system of the image formation apparatus 1A is different from the control system of the image formation apparatus 1 (FIG. 6) according to the first embodiment mainly in that the adhesion force reducer 50A includes the direct-current power source part 55*d*.

When a job is started, the CPU 101 sends a switching signal to the direct-current power source part 55*d* to control to switch between the magnetization and the non-magnetization of the coil depending on whether the toner image is transferred from the intermediate transfer belt 41 to the photoreceptor 32*r* or the toner image is transferred again from the photoreceptor 32*r* to the intermediate transfer belt 41. Thus, the positive and negative polarities of the direct-current voltage to be applied to the voltage application member 42*r* are switched. That is to say, when the multiple toner images are transferred from the intermediate transfer belt 41 to the photoreceptor 32*r*, the CPU 101 determines the polarity of the direct-current voltage to be applied to the voltage application member 42*r* so that the toner moves from the intermediate transfer belt 41 to the photoreceptor 32*r*. When the multiple toner images are transferred again from the photoreceptor 32*r* to the intermediate transfer belt 41, the CPU 101 inverts the polarity of the direct-current voltage to be applied to the voltage application member 42*r* so that the toner moves from the photoreceptor 32*r* to the intermediate transfer belt 41.

In the second embodiment described above, the adhesion force reducer 50A is provided between the secondary transfer member 61 and the most downstream side of the image formation step (primary transferor 40). The adhesion force reducer 50A includes the photoreceptor 32*r* (second image carrier) to which the toner image (multiple toner images) transferred to the intermediate transfer belt 41 is transferred. Then, before the secondary transfer, the multiple toner images on the intermediate transfer belt 41 are transferred to the photoreceptor 32*r* by the adhesion force reducer 50A, and after the photoreceptor 32*r* is rotated once, the multiple toner images are transferred to the intermediate transfer belt 41 again. After that, the multiple toner images are collectively transferred from the intermediate transfer belt 41 to the sheet S by the secondary transferor 60.

In this manner, before the secondary transfer, the multiple toner images are transferred temporarily from the intermediate transfer belt 41 to another image carrier (photoreceptor 32*r*) and then, the multiple toner images are transferred again to the intermediate transfer belt 41, and after that, the multiple toner images are collectively transferred to the sheet S. Thus, the adhesion force of the toner to the belt surface can be reduced regardless of the toner color in a manner similar to the first embodiment. Accordingly, the transfer property of the toner image to the uneven paper such as embossed paper in the secondary transferor 60 can be improved.

3. Third Embodiment

In a third embodiment, in a manner similar to the second embodiment, a toner image is transferred temporarily from the intermediate transfer body to another image carrier (second image carrier) before the secondary transfer and then, the toner image is transferred again to the intermediate transfer body. Here, instead of the image carrier with a drum shape (photoreceptor 32*r*), an image carrier with a belt shape is used as the second image carrier between the secondary transfer member 61 and the most downstream side of the image formation step (primary transferor 40). It can be said that the third embodiment is a modification of the second embodiment. Description is mainly made of a difference between the third embodiment and the second embodiment.

[Adhesion Force Reducing Part]

FIG. 13 illustrates a structure example of a transfer mechanism including an adhesion force reducer according to the third embodiment.

As illustrated in FIG. 13, the transfer mechanism according to the present embodiment includes an adhesion force reducer 50B between the secondary transfer member 61 and the photoreceptor 32K on the most downstream side of the image formation step.

The adhesion force reducer 50B includes a transfer belt 33 as one example of the second image carrier, a primary transfer counter member 34, a tension roller 35, the voltage application member 42*r* with a roller shape, and the direct-current power source part 55*d*. The voltage application member 42*r* is disposed to face the primary transfer counter member 34 through the intermediate transfer belt 41 and the transfer belt 33 on the inside of the intermediate transfer belt 41. The transfer belt 33 may have the same specification as that of the intermediate transfer belt 41 to which the multiple toner images are transferred. The adhesion force reducer 50B temporarily transfers the toner image which has been transferred to the intermediate transfer belt 41, onto the transfer belt 33 and then, after the transfer belt 33 is rotated once, the toner image is transferred again to the intermediate transfer belt 41; thus, the toner adhesion force is reduced.

The transfer belt 33 may be a conventional photosensitive belt. In the case of using a photosensitive belt as the transfer belt 33, an unshown image formation unit for forming an electrostatic latent image may be provided to the transfer belt 33. This image formation unit includes, for example, a structure of a part of the image formation unit 31, and more specifically includes a charging part that charges the photoreceptor 32*r* and an exposure part such as a laser light source. Here, in a manner similar to the second embodiment, an electrostatic latent image corresponding to the image pattern of the toner image carried by the photoreceptor 32 of each color (Y, M, C, K) on the upstream side is preferably formed on the transfer belt 33. Since this prevents the toner from scattering out of the electrostatic latent image on the surface of the transfer belt 33; thus, the image noise such as toner dust can be prevented more certainly. In this case, the region on the surface of the transfer belt 33 corresponding to the image pattern of the toner image is charged to have a polarity by which the toner is moved from the surface of the intermediate transfer belt 41.

The transfer belt 33 needs to have the belt length of such a degree that the toner image for the longest passable paper size can be transferred, and the distance between the rollers to which the transfer belt 33 is suspended may be increased in accordance with the convenience for the machine.

[Material and Setting Value of Each Component of Adhesion Force Reducer]

FIG. 14 shows a material of each component of the adhesion force reducer 50B of the transfer mechanism according to the third embodiment.

The transfer belt 33 is formed of, for example, polyimide resin. The primary transfer counter member 34 is formed using, for example, an NBR solid rubber roller. The tension roller 35 is a metal roller and is formed of, for example, SUS303. The example shown in FIG. 14 is a specification example of each component when the belt is used as the second image carrier, and the present invention is not limited to this example.

In the third embodiment described above, the adhesion force reducer 50B is provided between the secondary transfer member 61 and the most downstream side of the image formation step (primary transferor 40). The adhesion force reducer 50B includes the transfer belt 33 (second image carrier) to which the toner image (multiple toner images) transferred to the intermediate transfer belt 41 is transferred. Then, the multiple toner images on the intermediate transfer belt 41 are transferred to the transfer belt 33 by the adhesion force reducer 50B before the secondary transfer, and after the transfer belt 33 is rotated once, the multiple toner images are transferred to the intermediate transfer belt 41 again. After that, the multiple toner images are collectively transferred from the intermediate transfer belt 41 to the sheet S by the secondary transferor 60.

In this manner, the multiple toner images are transferred temporarily from the intermediate transfer belt 41 to another image carrier (transfer belt 33) before the secondary transfer, and then the multiple toner images are transferred again to the intermediate transfer belt 41, and after that, the multiple toner images are collectively transferred to the sheet S. Thus, the adhesion force of the toner to the belt surface can be reduced regardless of the toner color in a manner similar to the second embodiment. Accordingly, the transfer property of the toner image to the uneven paper such as embossed paper in the secondary transferor 60 can be improved.

4. Fourth Embodiment

In a fourth embodiment, an image carrier that can form an electrostatic latent image (electrostatic latent image carrier) and a voltage application member that can apply an alternating-current voltage are provided on the upstream side of the secondary transferor 60. The adhesion force of the toner to the belt surface is reduced by vibrating the toner by the alternating-current voltage, and then the collective transfer to the sheet is performed. In the present embodiment, the above structure is provided between the secondary transferor 60 and the most downstream side of the image formation step (primary transferor 40). In the description below, the alternating current may be referred to as AC.

Figure 15:
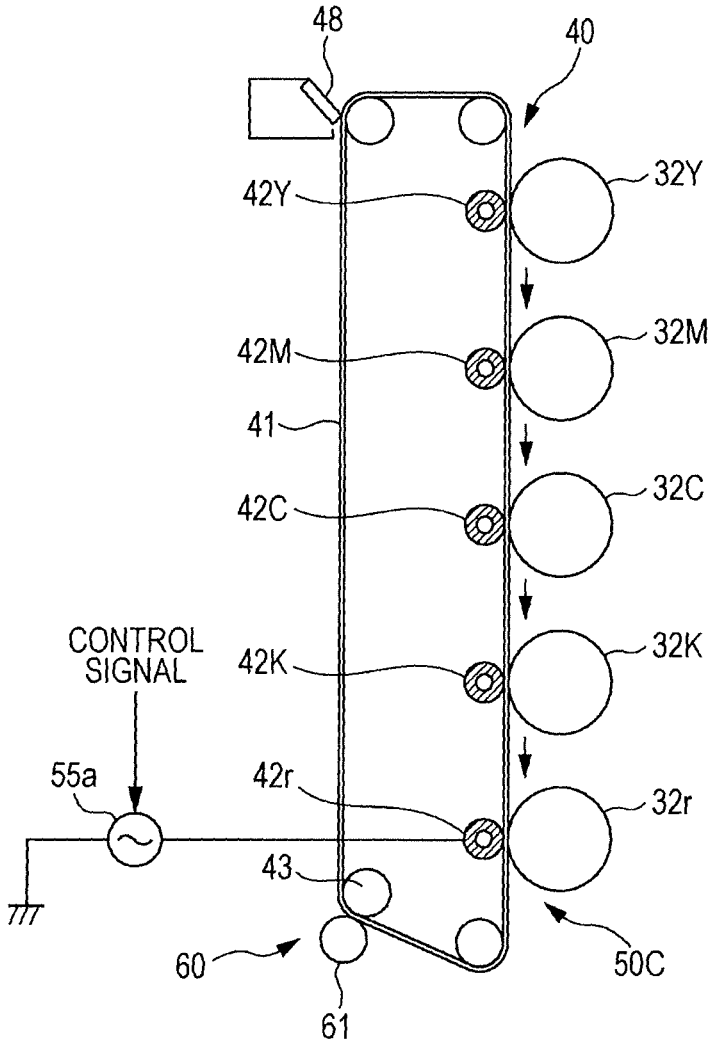
FIG. 15 is an explanatory view illustrating a structure example of a transfer mechanism including an adhesion force reducer according to a fourth embodiment of the present invention.

FIG. 15 illustrates a structure example of a transfer mechanism including an adhesion force reducer according to the fourth embodiment.

The transfer mechanism according to the present embodiment includes the adhesion force reducer 50C between the secondary transfer member 61 and the photoreceptor 32K on the most downstream side of the image formation step.

The adhesion force reducer 50C includes the photoreceptor 32*r* as the electrostatic latent image carrier, the voltage application member 42*r* with a roller shape, and an alternating-current power source part 55*a*. The voltage application member 42*r* is disposed on the inside of the intermediate transfer belt 41 so as to face the photoreceptor 32*r* with the intermediate transfer belt 41 interposed therebetween. The photoreceptor 32*r* may have the same specification as that of the photoreceptor 32 with a drum shape that is used to form a toner image of each color. The detailed specifications of the other components are the same as those in the second embodiment.

The adhesion force reducer 50C applies the alternating-current voltage generated in the alternating-current power source part 55*a*, to the voltage application member 42*r* when the multiple toner images on the intermediate transfer belt 41 pass the nip part between the intermediate transfer belt 41 and the photoreceptor 32*r*. Thus, an alternating-current electric field is generated in the transfer nip part, and the toner included in the multiple toner images vibrates between the photoreceptor 32*r* and the surface of the intermediate transfer belt 41, and thus the adhesion force of the toner to the belt surface is reduced.

Figure 16:
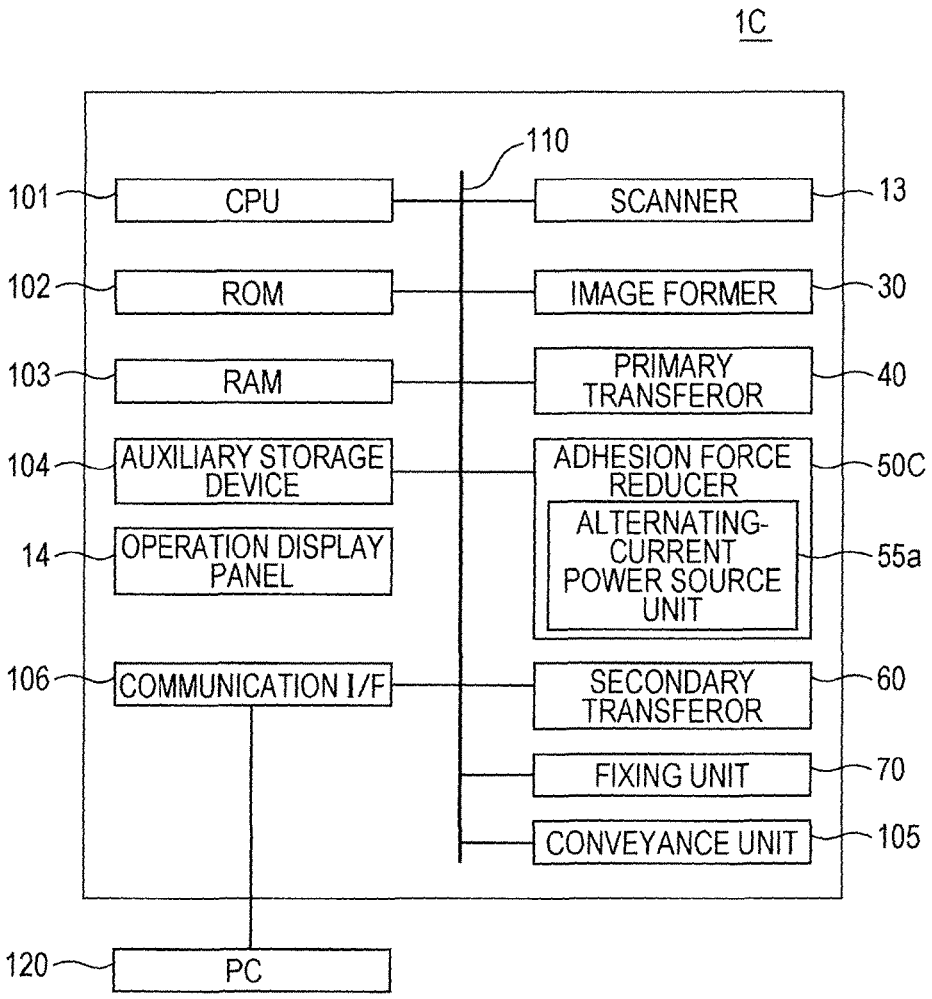
FIG. 16 is a block diagram illustrating a hardware structure example of an image formation apparatus according to the fourth embodiment of the present invention.

FIG. 16 illustrates a hardware structure example of an image formation apparatus 1C according to the fourth embodiment.

A control system of the image formation apparatus 1C is different from the control system of the image formation apparatus 1A (FIG. 12) according to the second embodiment mainly in that the adhesion force reducer 50C includes the alternating-current power source part 55*a*.

When a job is started, the CPU 101 causes a direct-current power source part that is not shown to apply a direct-current voltage to the primary transfer member 42 of each color in synchronization with the system speed. Moreover, the CPU 101 sends a control signal to the alternating-current power source part 55*a* so that the alternating-current power source part 55*a* generates an alternating-current voltage. The frequency of the alternating-current voltage may be a value at which the toner vibrates about four times while the sheet S passes the nip part (contact part) between the voltage application member 42*r* and the photoreceptor 32*r*. Needless to say, the frequency may be a value at which the toner vibrates three times or five or more times. By vibrating the toner, the adhesion force of the toner to the belt surface can be weakened.

By applying the alternating-current voltage through the voltage application member 42*r* to the photoreceptor 32 (electrostatic latent image carrier) which depends on an environment (for example, temperature and humidity) less than paper and whose property such as flatness is clear, it is not necessary to set the alternating-current voltage parameter for each paper type and the alternating-current voltage can be applied effectively.

Note that the alternating-current voltage may be generated in accordance with a timing at which the sheet S passes the nip part. In this case, the power consumption can be reduced as compared to the case where the alternating-current voltage is generated through the job. When the toner adhesion force reducing function is not used, the CPU 101 cancels the nip between the voltage application member 42*r* and the photoreceptor 32*r* (the contact of the voltage application member 42*r* with the photoreceptor 32*r* (intermediate transfer belt 41)). This is the same as the usual operation of the primary transfer mechanism.

FIG. 17A and FIG. 17B show examples of the voltage applied to the voltage application member 42*r*, and FIG. 17A shows an example of a sine wave and FIG. 17B shows an example of a rectangular wave. In FIG. 17A and FIG. 17B, a horizontal axis represents time and a vertical axis represents an application voltage. In FIG. 17A, a peak voltage width $V_{PP}$ represents a difference between a maximum value and a minimum value of the sine wave, and $V_B$ represents an offset voltage. The alternating-current voltage to be applied to the voltage application member 42*r* may be either a sine wave or a rectangular wave. Description is hereinafter made of a case in which the alternating-current voltage of a sine wave is applied.

In order to return the toner adhering to the photoreceptor 32*r* back to the intermediate transfer belt 41 by the vibration, the direct-current voltage bias (hereinafter referred to as "DC bias") is offset to obtain "return current". The AC component reduces the adhesion force by vibrating the toner, so that the toner becomes movable to the photoreceptor 32*r*. The DC component returns the toner to the intermediate transfer belt 41. If the toner has a negative polarity, the positive DC bias is used. To determine the DC bias, a conventional auto transfer voltage control (ATVC) is used. The control may be performed by a predetermined voltage.

The ATVC is to determine an optimal transfer voltage by detecting a transfer voltage that is applied to the transfer member when a certain amount of current flows to the transfer member by a constant-current control at a non-transfer time other than the transfer time, determining an electric resistance value of the transfer member from the detected voltage value and the current value, and referring to a table expressing a correlation between the determined electric resistance value and the optimal transfer voltage value. In the preliminary examination, the following condition was obtained in order to generate sufficiently the vibration of the toner in the structure of the present embodiment.

In environment with a temperature 20° C. and a humidity of 50%: $V_{PP}$ 6.0 kV, 500 Hz, required return current: 40 μA In environment with a temperature 10° C. and a humidity of 20%: $V_{PP}$ 8.0 kV, 500 Hz, required return current: 50 μA In environment with a temperature 30° C. and a humidity of 80%: $V_{PP}$ 4.5 kV, 500 Hz, required return current 30 μA These parameter values may be determined by the preliminary examination for sufficiently reducing the adhesion force of the toner in each machine structure, and the setting of the AC parameters is not limited to this example. Depending on the environment, a more segmented table may be used or the parameters may be changed continuously by a function. In the structure and the specification of the present embodiment, the peak voltage width $V_{PP}$ is preferably in the range of 4.0 to 8.5 kV and the frequency is preferably in the range of 200 to 1000 Hz.

In the present embodiment, a secondary transfer bias is controlled on the basis of the DC bias value when the alternating-current voltage is applied. The DC bias value when the alternating-current voltage is applied is subjected to a feed-back control to the secondary transfer bias. The same energy as the energy when the DC bias value is fed back to the secondary transfer bias of the secondary transfer member 61 and returned to the intermediate transfer belt 41 is applied to the toner, and thus, only the toner that has become movable can be transferred to the sheet S efficiently. The ATVC is performed by the required return current, and the necessary overlapping DC bias is determined.

FIG. 18 shows an environment and a result of the ATVC related to the fourth embodiment.

In the example of FIG. 18, a voltage of 2.0 kV is obtained as a result of the ATVC under the environment with a temperature of 20° C. and a humidity of 50%. Thus, the alternating-current voltage of a sine wave to be applied from the alternating-current power source part 55*a* to the voltage application member 42*r* (AC condition+DC condition) is as follows.

AC condition: $V_{PP}$ 6.0 kV, 600 Hz

DC condition: 2.0 kV

When the detection result of the DC current at this time is, for example, a DC current value of 75 μA, a DC current of 75 μA is supplied to the secondary transfer member 61. This DC current value may be corrected in accordance with the paper type, paper width, environment, or the like and then the corrected DC current value may be supplied to the secondary transfer member 61.

Figures 19, 20:
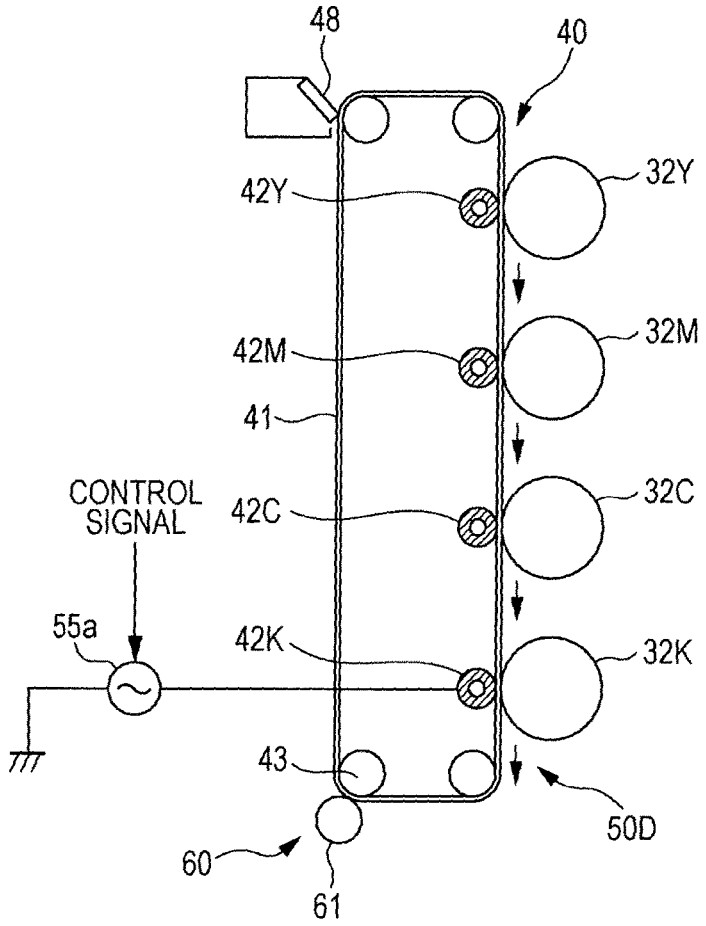
FIG. 19 is a table expressing results of evaluating the transfer property to embossed paper by using the transfer mechanism according to the fourth embodiment of the present invention and the transfer mechanism according to the comparative example.
FIG. 20 is an explanatory view illustrating a structure example of a transfer mechanism including an adhesion force reducer according to a fifth embodiment of the present invention.

FIG. 19 is a table expressing results of evaluating the transfer property to the embossed paper as the uneven paper using the transfer mechanism of the image formation apparatus 1C and the transfer mechanism of the comparative example (FIG. 1). In the evaluation of the transfer property of FIG. 19, the transfer mechanism of the structure illustrated in FIG. 1 is the comparison target.

In the measurement, embossed paper of LEATHAC white 302 gsm was used and this is similar to the case of FIG. 9. In the current measurement, comparison was performed in regard to the toner images of the halftone that were transferred from the yellow photoreceptors 32Y and 232Y, the toner images of the solid printing (one-layer solid printing) that were transferred from the yellow photoreceptors 32Y and 232Y, and the toner images of the solid printing (two-layer solid printing) that were transferred from the yellow photoreceptors 32Y and 232Y and the magenta photoreceptors 32M and 232 M. The transfer property was evaluated visually, in a manner similar to the case of FIG. 9.

As shown in FIG. 19, the excellent results (⊙ mark) were obtained in regard to the toner images of the halftone and the one-layer solid printing also in the structure of the fourth embodiment. In addition, the good result (○ mark) was obtained in regard to the toner image of the two-layer solid printing. On the other hand, in the structure of the comparative example, the result of the toner image of the halftone was below average (Δ mark) and the results of the toner images of the one-layer solid printing and two-layer solid printing were poor (× mark). The similar tendency was observed in regard to other embossed paper.

In the fourth embodiment described above, the adhesion force reducer 50C is provided between the secondary transfer member 61 and the most downstream side of the image formation step (primary transferor 40). The adhesion force reducer 50C includes the photoreceptor 32*r* (electrostatic latent image carrier) and the voltage application member 42*r*. Then, by applying the alternating-current voltage to the voltage application member 42*r* to vibrate the toner included in the toner image (multiple toner images) transferred to the intermediate transfer belt 41 in the nip part, the adhesion force of the toner to the belt surface can be reduced. Accordingly, the transfer property of the toner image to the uneven paper such as embossed paper in the secondary transferor 60 can be improved.

Although the photoreceptor 32 with a drum shape that is the same as the photoreceptors of the other colors is used as the electrostatic latent image carrier, the photosensitive belt may be used alternatively. In addition, although the photoreceptor with a drum shape having the same diameter is illustrated in this example, a photosensitive drum or a photosensitive belt with the size in accordance with the maximum image length may be used. In this structure, the machine can be used in a manner that the contact of the adhesion force reducer 50C with the voltage application member 42*r* is canceled except when the uneven paper such as embossed paper is used. On the electrostatic latent image carrier of the adhesion force reducer 50C, an electrostatic latent image in accordance with the image pattern is formed in advance. Thus, in a case where the alternating-current voltage is applied, the toner will not scatter out of the electrostatic latent image when the toner vibrates (reciprocates in the nip part), and the adhesion force of the toner to the belt surface can be reduced.

5. Fifth Embodiment

In a fifth embodiment, a voltage application member and an image carrier as the adhesion force reducer on the upstream side of the secondary transferor 60 are the primary transferor positioned on the most downstream side of the image formation step (primary transferor 40).

FIG. 20 illustrates a structure example of a transfer mechanism including an adhesion force reducer according to the fifth embodiment.

As illustrated in FIG. 20, in the present embodiment, the primary transfer member 42K and the photoreceptor 32K for the black, which serve as the primary transferor on the most downstream side of the primary transferor 40, are used as an adhesion force reducer 50D. To the primary transfer member 42K, the alternating-current power source part 55*a* is connected. Although the primary transferor for the black is used as the primary transferor at the most downstream position of the primary transferor 40, another color may be used alternatively. In a case where there is a primary transferor for a particular color such as clear toner or white toner, such a primary transferor may be used when the particular color is unused.

Note that a material and setting values of each component of the transfer mechanism including the adhesion force reducer 50D according to the present embodiment are the same as those of the fourth embodiment; thus, the description is omitted. In addition, a control system of an image formation apparatus according to the present embodiment is the same as the control system according to the fourth embodiment (see FIG. 16); therefore, the description is omitted.

Description is hereinafter made of a case in which an alternating-current voltage is applied to the primary transfer member 42K (voltage application member) with reference to FIG. 21. A rectangular wave is described as an example below; however, a sine wave may be used alternatively.

Figures 21, 22:
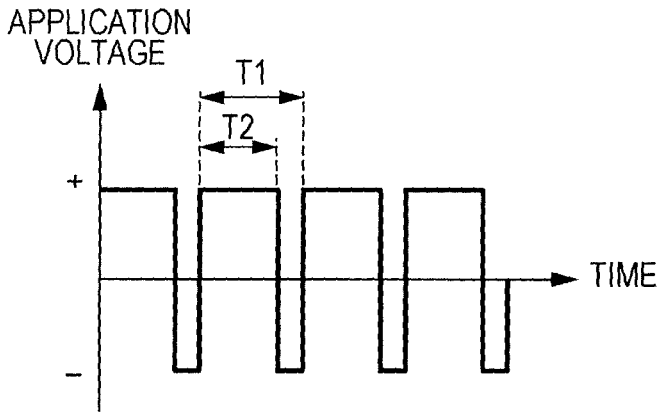
FIG. 21 is an explanatory view showing a rectangular wave as an example of an application voltage to a primary transfer member (voltage application member) according to the fifth embodiment of the present invention.
FIG. 22 is a table expressing results of evaluating the transfer property to embossed paper by using the transfer mechanism according to the fifth embodiment of the present invention and the transfer mechanism according to the comparative example.

FIG. 21 shows a rectangular wave as an example of the application voltage to the primary transfer member 42K. In FIG. 21, a horizontal axis represents the time and a vertical axis represents the application voltage. The duty ratio of the rectangular wave is expressed by a proportion of a target period in the length of one cycle. The duty ratio of the positive polarity in FIG. 21 is expressed by T2/T1. If the toner polarity is negative, the duty ratio on the positive side of the rectangular wave is made larger than that on the negative side so as to increase the force of returning the toner to the intermediate transfer belt 41. On the contrary, if the toner polarity is positive, the duty ratio on the negative side of the rectangular wave is made larger than that on the positive side so as to increase the force of returning the toner to the intermediate transfer belt 41.

The duty ratio may be determined based on the mechanical structure of the image formation apparatus, and is preferably in the range of 65 to 90% in order to attract the toner to the belt surface side in the present embodiment. More preferably, the duty ratio is set in the range of 75 to 85%. These ranges are determined from the image quality of a printed object output from the image formation apparatus to which the present embodiment has been applied. The peak voltage width $V_{PP}$ and the frequency of the rectangular wave may be determined in advance in accordance with the machine structure and are preferably in the range similar to that of the fourth embodiment. Here, independently of the environment, the peak voltage width $V_{PP}$ is set to 6.5 kV, the frequency is set to 750 Hz, and the positive side duty ratio is set to 85% and thus, the voltage is applied to the primary transfer member 42K.

In the present embodiment, the alternating-current voltage in which the DC bias voltage is overlapped is applied to the primary transfer member 42K for the black; however, usually, the electrostatic latent image is the latent image of the black only. However, in a case of the adhesion force reducer 50D using the primary transferor for the black, the electrostatic latent images of the other colors are formed on the photoreceptor 32K for black to such a degree that the black toner is not developed. This can prevent the toner dust of the other colors. In this case, if the electrostatic latent images of the other colors formed on the photoreceptor 32K are too deep (charging potential is too large), the black toner adheres to the electrostatic latent images of the other colors, and on the other hand, if the electrostatic latent images of the other colors formed on the photoreceptor 32K are too shallow (charging potential is too small), the effect of preventing the toner dust of the other colors cannot be obtained.

The DC current value detected when the AC condition was $V_{PP}$ 6.5 kV at a frequency of 750 Hz and the rectangular wave with a positive side duty ratio of 85% was applied to the primary transfer member 42K was 68 μA. Therefore, the DC current for 75 μA is supplied to the secondary transfer member 61. Regarding this 68 μA as a reference current value, the correction may be performed in accordance with the paper type, paper width, environment, or the like.

FIG. 22 is a table expressing results of evaluating the transfer property to the embossed paper using the transfer mechanism according to the fifth embodiment and the transfer mechanism of the comparative example. In the evaluation of the transfer property of FIG. 22, the transfer mechanism of the structure illustrated in FIG. 1 is the comparison target.

In the measurement, embossed paper of LEATHAC white 302 gsm was used and this is similar to the case of FIG. 9 and FIG. 19. In the current measurement, comparison was performed in regard to the toner images of the halftone that were transferred from the yellow photoreceptors 32Y and 232Y, the toner images of the solid printing (one-layer solid printing) that were transferred from the yellow photoreceptors 32Y and 232Y, and the toner images of the solid printing (two-layer solid printing) that were transferred from the yellow photoreceptors 32Y and 232Y and the magenta photoreceptors 32M and 232 M. The transfer property was evaluated visually, in a manner similar to the case of FIG. 9 and FIG. 19.

As shown in FIG. 22, the excellent results (⊙ mark) were obtained in regard to the toner images of the halftone and the one-layer solid printing also in the structure of the fifth embodiment. In addition, the good result (○ mark) was obtained in regard to the toner image of the two-layer solid printing. On the other hand, in the structure of the comparative example, the result of the toner image of the halftone was below average (Δ mark) and the results of the toner images of the one-layer solid printing and two-layer solid printing were poor (× mark). The similar tendency was observed in regard to other embossed paper.

In the fifth embodiment described above, the primary transfer member 42K and the photoreceptor 32K (electrostatic latent image carrier) at the most downstream position of the image formation step (primary transferor 40) were used as the adhesion force reducer 50D. Then, by applying the alternating-current voltage to the voltage application member 42*r* to vibrate the toner included in the toner image (multiple toner images) transferred to the intermediate transfer belt 41 in the nip part, the adhesion force of the toner to the belt surface can be reduced. Accordingly, the transfer property of the toner image to the uneven paper such as embossed paper in the secondary transferor 60 can be improved.

6. Sixth Embodiment

In the fourth embodiment and the fifth embodiment described above, if the paper width in a main scanning direction of the sheet (in a direction parallel to an axis of the photoreceptor 32) is narrow, for example, current does not flow easily and the effect of reducing the toner adhesion force is not obtained sufficiently. In view of this, a sixth embodiment will describe an example in which the DC current to be supplied to the secondary transfer member 61 is corrected in accordance with the paper width of the sheet S. Description is hereinafter made of the relation between the basis weight and the paper width of the sheet S as one example.

FIG. 23 is a paper width correction table expressing a relation between the basis weight and the paper width in the sixth embodiment.

As the paper width of the sheet S, "150 mm or less", "151 mm to 210 mm", "211 mm to 300 mm", and "300 mm or more" are set. As the basis weight, "60 gsm or less", "61 gsm to 80 gsm", "81 gsm to 105 gsm", "106 gsm to 128 gsm", "129 gsm to 160 gsm", "161 gsm to 200 gsm", and "200 gsm or more" are set. The unit of numerals in the paper width correction table is microamperes (μA).

It is assumed that an A4-size sheet with a paper width of 210 mm and a basis weight of 65 gsm is printed. In the example described in the fifth embodiment, the DC current value is 68 μA, and in a case of the A4-size paper, the correction amount is "+5" according to the paper width correction table in FIG. 23, so that the DC current value after the correction is 73 μA. When the basis weight is in the same range, as the paper width becomes smaller, it is likely that the amount of correction is increased and the DC current value is increased. When the paper width is in the same range, as the basis weight becomes larger, it is likely that the amount of correction is increased and the DC current value is increased. When the sheet is the same, as the humidity in the transfer mechanism or in the room is higher, the amount of correction is increased because current flows less easily.

In the sixth embodiment described above, the value of DC current (secondary transfer bias) to be supplied to the secondary transfer member 61 is corrected on the basis of at least the paper type, paper width, and environment. Thus, the DC current appropriate in accordance with the sheet or environment condition can be supplied to the secondary transfer member 61. Therefore, in the secondary transferor 60, the toner image can be transferred as appropriate to the uneven paper such as embossed paper.

Note that in the example illustrated in FIG. 20, the photoreceptor 32K is used as the adhesion force reducer 50D; however, the photoreceptor 32C on the upstream side of the photoreceptor 32K may be used as the adhesion force reducer 50D alternatively.

7. Others

In the above embodiments, in a case where paper with small surface unevenness such as plain paper is used as the sheet S instead of paper with large surface unevenness such as embossed paper or groundwood paper, a gradation pattern based on the uneven pattern does not appear. Therefore, each transfer bias including the direct-current voltage only may be applied. However, in the second to sixth embodiments, in a case where the uneven paper with large surface unevenness is used, it is necessary to switch the transfer bias related to the adhesion force reducing function from the transfer bias including only a direct-current voltage to the transfer bias in which a direct-current voltage is overlapped on an alternating-current voltage.

For example, in the second to fourth embodiments and the sixth embodiment, in a case where the paper to be printed is not the uneven paper, the CPU 101 performs the image formation after canceling (separating) the contact between the image carrier (photoreceptor 32*r* or the transfer belt 33) and the voltage application member 42*r* of the adhesion force reducer through the intermediate transfer belt 41 (first intermediate transfer body). In this case, basically, the image carrier (photoreceptor 32*r* or transfer belt 33) is separated from the intermediate transfer belt 41; however, the voltage application member 42*r* may be separated from the intermediate transfer belt 41. Alternatively, both the image carrier and the voltage application member 42*r* may be separated from the intermediate transfer belt 41.

On the other hand, if it is determined that the sheet to be printed is the uneven paper on the basis of the output setting of the job or the user's instruction on the operation display panel 14, the CPU 101 causes the image carrier and the voltage application member 42*r* of each adhesion force reducer to be brought into contact with each other having the intermediate transfer belt 41 interposed therebetween. Then, the toner adhesion force reducing function of each embodiment described above is operated. Thus, the secondary transfer is performed on the sheet other than the uneven paper, such as plain paper, with the normal toner adhesion force, and the toner adhesion force reducing function is performed on only the uneven paper. Accordingly, the excellent transfer property is maintained regardless of the paper type.

If the toner adhesion force reducing function is not used in the second to sixth embodiments described above, it is also possible that the alternating-current voltage for reducing the adhesion force is not supplied to the voltage application member of each adhesion force reducer.

In the second to fifth embodiments described above, the adhesion force reducer is provided between the secondary transferor 60 and the most downstream side of the image formation step; however, the present invention is not limited to this structure. The adhesion force reducer is to reduce the adhesion force of the toner image included in the multiple toner images; therefore, it is only necessary that the toner images (multiple toner images) of at least two colors that are carried by the plurality of photoreceptors 32 are formed on the intermediate transfer belt 41. Therefore, for example, the adhesion force reducer may be formed between the photoreceptor 32M and the photoreceptor 32C or between the photoreceptor 32C and the photoreceptor 32K.

It is only necessary that the toner images (multiple toner images) of at least two colors that are carried by the plurality of photoreceptors 32 are formed on the intermediate transfer belt 41; this does not entirely exclude the case in which the present invention is applied to a toner image of a single color. The present invention is also applicable to a case in which an image is formed of only a toner image of a single color in an apparatus capable of forming multiple toner images such as the image formation apparatus 1.

In addition, the present invention is not limited to the embodiments and the examples described above, and various other applications and modifications are possible unless departing from the concept of the present invention described in the scope of claims.

For example, the above embodiments and examples are to describe in detail and specifically the structure of the apparatus and the system in order to clarify the present invention and are not limited to the example including all the described structures. A part of the structure of a certain embodiment or example can be replaced with a structure of another embodiment or example. Moreover, to a structure of a certain embodiment or example, a structure of another embodiment or example can be added. Furthermore, for a part of a structure of each embodiment or example, another structure may be added, deleted, or replaced.

Each structure, function, processing part, processor, or the like described above may be either partly or entirely achieved using hardware by, for example, designing it with an integrated circuit. Control lines and information lines that are considered necessary in the description are shown but all the control lines and information lines of a product are not necessarily shown. In fact, it may be considered that all the structures are mutually connected.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image formation apparatus comprising:

a plurality of image formers each of which is provided for each color and forms a toner image;

a plurality of image carriers each of which is provided in accordance with each of the image formers and carries the toner image formed by each image former;

a first intermediate transfer body on which multiple toner images are formed in a manner that the toner images of at least two colors that are carried by the plurality of image carriers are primarily transferred by primary transferors;

a secondary transferor that secondarily transfers to a sheet, the multiple toner images formed on the first intermediate transfer body; and an adhesion force reducer that is provided between a position where the multiple toner images are formed on the first intermediate transfer body and a secondary transfer position of the secondary transferor and that reduces an adhesion force of toner included in the multiple toner images formed on the first intermediate transfer body, wherein the adhesion force reducer includes a second intermediate transfer body to which the multiple toner images are transferred in contact with the first intermediate transfer body, the multiple toner images transferred to the second intermediate transfer body are secondarily transferred to the sheet by the secondary transferor, and a pressing force for pressing the first intermediate transfer body against the second intermediate transfer body is smaller than a pressing force for pressing the first intermediate transfer body against the plurality of image carriers in the primary transfer.

2. The image formation apparatus according to claim 1, wherein the adhesion force reducer performs a process of reducing the adhesion force of toner included in the multiple toner images formed on the first intermediate transfer body when the sheet is uneven paper.

3. An image formation method by an image formation apparatus including a plurality of image formers each of which is provided for each color and forms a toner image, a plurality of image carriers each of which is provided in accordance with each of the image formers and carries the toner image formed by each image former, a first intermediate transfer body on which multiple toner images are formed in a manner that the toner images of at least two colors that are carried by the plurality of image carriers are primarily transferred by primary transferors, and a secondary transferor that secondarily transfers to a sheet, the multiple toner images formed on the first intermediate transfer body, the method comprising reducing an adhesion force of toner included in the multiple toner images formed on the first intermediate transfer body by an adhesion force reducer that is provided between a position where the multiple toner images are formed on the first intermediate transfer body and a secondary transfer position of the secondary transferor, the adhesion force reducer including a second intermediate transfer body to which the multiple toner images are transferred in contact with the first intermediate transfer body, the multiple toner images transferred to the second intermediate transfer body being secondarily transferred to the sheet by the secondary transferor, by pressing the first intermediate transfer body against the second intermediate transfer body with a pressing force smaller than a pressing force for pressing the first intermediate transfer body against the plurality of image carriers in the primary transfer.

4. An image formation apparatus comprising:

a plurality of image formers each of which is provided for each color and forms a toner image;

a plurality of image carriers each of which is provided in accordance with each of the image formers and carries the toner image formed by each image former;

a first intermediate transfer body on which multiple toner images are formed in a manner that the toner images of at least two colors that are carried by the plurality of image carriers are primarily transferred by primary transferors;

a secondary transferor that secondarily transfers to a sheet, the multiple toner images formed on the first intermediate transfer body; and an adhesion force reducer that is provided between a position where the multiple toner images are formed on the first intermediate transfer body and a secondary transfer position of the secondary transferor and that reduces an adhesion force of toner included in the multiple toner images formed on the first intermediate transfer body, wherein the adhesion force reducer includes a second intermediate transfer body to which the multiple toner images are transferred in contact with the first intermediate transfer body, the multiple toner images transferred to the second intermediate transfer body are secondarily transferred to the sheet by the secondary transferor, a pressing force for pressing the first intermediate transfer body against the second intermediate transfer body is smaller than a pressing force for pressing the first intermediate transfer body against the plurality of image carriers in the primary transfer, and a hardness of a transfer member for pressing the first intermediate transfer body against the second intermediate transfer body is smaller than a hardness of a primary transfer member for pressing the first intermediate transfer body against the plurality of image carriers.

5. The image formation apparatus according to claim 4, wherein the adhesion force reducer performs a process of reducing the adhesion force of toner included in the multiple toner images formed on the first intermediate transfer body when the sheet is uneven paper.

* * * * *